US005789723A

United States Patent [19]

Hirst

[11] Patent Number: 5,789,723

[45] Date of Patent: Aug. 4, 1998

[54] REDUCED FLICKER FUSING SYSTEM FOR USE IN ELECTROPHOTOGRAPHIC PRINTERS AND COPIERS

[75] Inventor: B. Mark Hirst, Boise, Id.

[73] Assignee: Hewlett-Packard Company, Palo Alto, Calif.

[21] Appl. No.: 704,216

[22] Filed: Aug. 23, 1996

[51] Int. Cl.[6] ..... H05B 1/02

[52] U.S. Cl. ..... 219/501; 219/505; 219/216; 219/497; 323/290; 323/241

[58] Field of Search ..... 219/501, 497, 219/481, 508, 499, 505, 216; 323/300, 319, 239, 236, 290, 265, 241

[56] References Cited

U.S. PATENT DOCUMENTS 3,763,395 10/1973 Shilling et al. ..... 315/307
4,873,618 10/1989 Frederick et al. ..... 363/17
4,928,055 5/1990 Kaieda et al. ..... 323/300
5,101,142 3/1992 Chatfield ..... 315/308
5,373,141 12/1994 Ko ..... 219/497
5,483,149 1/1996 Barrett ..... 323/300
5,623,187 4/1997 Calderia et al. ..... 315/307

*Primary Examiner*—Mark H. Paschall
*Attorney, Agent, or Firm*—Anthony J. Baca

[57] ABSTRACT

A new linear power control topology coupled with simple control techniques are presented which virtually eliminate the flicker problem as well as providing excellent power quality over a wide range of power levels. A modified one dimensional LMS control system similar to the standard LMS algorithm with multiple operating points and gain scheduling is also described which when combined with the new power control topology yield a dramatic reduction in flicker while yielding a universal voltage interface for world wide use.

20 Claims, 26 Drawing Sheets

REDUCED FLICKER FUSING SYSTEM FOR USE IN ELECTROPHOTOGRAPHIC PRINTERS AND COPIERS

CROSS-REFERENCE TO RELATED APPLICATION

The present application is related to the following co-pending U.S. Patent applications being assigned to the same assignee and filled on the same date, entitled: "A METHOD FOR REDUCING FLICKER IN ELECTROPHOTOGRAPHIC PRINTERS AND COPIERS", U.S. Ser. No. 08/701,898 incorporated herein by reference.

"USE OF THE TEMPERATURE GRADIENT TO DETERMINE THE SOURCE VOLTAGE", U.S. Ser. No. 08/704,217 incorporated herein by reference; and "A UNIVERSAL POWER SUPPLY FOR MULTIPLE LOADS", U.S. Ser. No. 08/697,38 incorporated herein by reference.

TECHNICAL FIELD

This invention relates generally to power control systems and more particular to a method and apparatus for controlling the amount of power supplied to a resistive heating element while reducing flicker.

BACKGROUND OF THE INVENTION

Starting in approximately 1984, low cost personal laser printers became available. Almost all laser printers manufactured worldwide to date suffer from excessive flicker as measured by the proposed European regulatory document IEC 555-3. Flicker is defined as the impression of unsteadiness of visual sensation induced by a light stimulus whose luminance or spectral distribution fluctuates with time. In electrical power distribution systems flicker is the result of large current changes reacting with the power distribution system impedance causing voltage fluctuations. These voltage fluctuations, in the form of voltage sags and surges, cause the light output of incandescent lamps to fluctuate and can cause fluorescent lamps to drop out. Flicker in incandescent lamps is easily noticed because photonic emissions for incandescent lamps is a nonlinear function of the voltage source and any voltage deviation causes a much larger deviation in the luminescent intensity of the light emitted from the incandescent lamp. Light flicker is visually irritating and also represents unwanted harmonics and power transients being placed on a power system.

All dry electrophotographic copiers and printers develop an image utilizing a dry toner. The typical toner is composed of styrene acrylic resin, a pigment-typically carbon black, and a charge control dye to endow the toner with the desired tribocharging properties for developing a latent electrostatic image. Styrene acrylic resin is a thermo-plastic which can be melted and fused to the desired medium, typically paper.

The typical fusing system in an electrophotographic printer or copier is composed of two heated platen rollers which, when print media with a developed image pass between them, melt the toner and through pressure physically fuse the molten thermal plastic to the medium. Heating is usually accomplished by placing a high power tungsten filament quartz lamp inside the hollow platen roller.

The heating element in the fusing system provides enough heat to properly fuse the toner to the medium. The fusing system must compensate for different media types, changes in ambient environmental temperature, as well as dramatic changes in relative humidity. Relative humidity variations greatly affect the fusing system due to the hygroscopic properties of both the print media and the toner itself. When relative humidity is high both the media and toner absorb a large percentage of their dry mass in water that is essentially boiled off during the fusing process thus decreasing the amount of energy available for melting the toner for adhesion to the media. Thus, the fusing system must accommodate a large variety of environmental conditions as well as differing media demands.

Presently, most printer and copier fusing systems and their temperature control systems are not designed to compensate for differing media types or changes in relative humidity. The typical fusing system is designed with a heating element capable of providing enough heat to deal with all foreseen media and relative humidity conditions with little or no concern to the resulting poor power quality that results. Some relatively new printers do utilize relative humidity sensors to adjust print quality and optical sensors to differentiate between paper and overhead transparencies. These additional sensors, which are being added to the printing mechanisms in order to improve image quality, can also be utilized by the fuser control systems to improve temperature regulation as well as improve the power quality of the overall printing system.

There are numerous reasons to intelligently control a electrophotographic printer or copier fusing system in a much more aggressive manner. First, intelligent control can result in a universal fuser that can be shipped to any commercial market worldwide regardless of the power system. The universal fuser is a fusing system which can be connected to any low voltage public power system worldwide. Second, a flicker free universal fuser has the attractive benefit of requiring a single part for both manufacture and field service replacement. The manufacturer is relieved of the burden of manufacturing 110 VAC and 220 VAC printers. The need to stock two types of service parts is eliminated, and product distribution centers now have one product that can be shipped to any country in the world without any reconfiguration requirements. There are reduced logistical burdens for sales, distribution and manufacture scheduling. As can be expected there is a large financial advantage to be gained by producing only a single version of a product for worldwide consumption.

For a dry electrophotographic fusing system to operate worldwide it must be able to operate satisfactorily on AC power systems providing from 90 Vrms to 240 Vrms at frequencies of 50 Hz to 60 Hz. The fusing system must heat up from ambient room temperature to operating temperature as quickly as possible while exhibiting extremely low flicker as its power consumption level changes. The fusing system, when combined with the balance of the electrophotographic printer power electronics, must meet International Electrical Commission (IEC) regulations IEC 555-2 and IEC 555-3 for current harmonics and flicker. The printer must pass Federal Communications Commission (FCC) class B regulations for power line conducted emissions and radiated emissions. In addition, the printer must pass CISPR B requirements for power line conducted emissions and radiated emissions. Finally, the printer must not suffer from excessive acoustic multi-tone or single tone emissions in the human auditory range in the office environment. The fusing system must be capable of switching into a power down or power off mode for energy savings as suggested by the EPA Energy Star Program. The absolute cost of any additional electronics is limited to no more than the cost benefit of not stocking multiple 110 VAC and 220 VAC models.

Measurements of the power transient loads of fusing systems show that a cold fusing system in the Hewlett Packard "Color LaserJet" ® printer placed an instantaneous power transient load of over 15 KW on the power line for a few hundred milliseconds while the fuser filament in its fusing system heats up and its thermal resistance increases. After the initial power surge has occurred and the tungsten heating filament is near operating temperature, the average power consumed at operating speeds is about 350 W with peaks of over 950 W. These printers also have an average idle power of about 90 W with peaks of over 950 W as the fuser system cycles on and off. The large power transients generated when the fusing system is first energized and for repeated energizations are the chief source of flicker.

U.S. Pat. No. 5,483,149 to Barrett (herein referred to as Barrett) shows that a universal fuser may be obtained through the use of a modified integral half cycle (IHC) power controller but without solving the flicker problem. The method taught by Barrett has been shown to suffer some flicker problems as well as placing current sub-harmonics on the AC power system. Currently no regulation exists regarding AC current sub-harmonic content. It is sufficient to note that AC current sub-harmonics are unwanted on the power grid and that AC current sub-harmonics in the 4 Hz to 20 Hz range significantly contributes to the flicker level exhibited by an electrical device.

A universal fuser based on IHC control also has difficulty with IEC 555-3 requirements for flicker due to large currents drawn during initial warm-up of the fusing system. IHC and pseudo-random IHC controllers also experience flicker problems while running, especially in the new low thermal mass (low thermal time constant fuser), as they place voltage fluctuations near the 8–10 Hz region where the proposed flicker regulations are tightest and the human eye flicker perception the greatest.

Other methods such as phase control, in which a triac's conduction angle is ramped up relatively slowly, have proven to yield a universal fusing system which meets IEC 555-3 specifications for flicker yet fails IEC 555-2 specifications for current harmonics. Triac gate phase control also fails conducted power line emission specifications unless excessive additional power filtering is added. In U.S. Pat. No. 4,928,055 to Kaieda et al. (herein referred to as Kaieda) a fuser power control system based on phase delay gated triac control of an AC heating system is taught. While Kaieda was only interested in power control, through proper temperature control algorithm design as taught in co-pending application "A METHOD FOR REDUCING FLICKER IN ELECTROPHOTOGRAPHIC PRINTERS AND COPIERS", U.S. Ser. No. 08/701,898, their solution could greatly reduces the flicker problem while yielding a universal fuser. However, this solution requires detailed information and the associated expense of voltage magnitude as well as zero cross information for proper triac gate control. This system also suffers from excessive current harmonics as well as places large amounts of conducted emissions on the power grid.

Many authors have performed studies of the temporal response of the human visual system to quantify human visual perception of changes in ambient light as functions of intensity change, rate of change, and type of change. These psycho-physiological studies have shown that the human visual system is most sensitive to light intensity changes near the rate of 8 Hz to 10 Hz. Kendal, ("Light flicker in relation to power-system voltage fluctuation", Proc. IEE, 1966, 113 (3), p.472)(incorporated herein by reference) among others, shows perceived flicker levels for various relative percent voltage changes verses frequency for sinusoidal, triangular, and square voltage fluctuations. Kendal's work shows that the human visual system is most sensitive to flicker due to square voltage fluctuations and his work is cited by both the IEEE-519 and IEC 555-3 documents.

The proposed international standard for regulating flicker, IEC 555-3, is based on these studies and utilizes a model of the human threshold of annoyance verses percent voltage change and repetition rate to measure and limit the amount of flicker that an electrical apparatus may exhibit.

Presently, there are no regulatory requirements in the US which limit the amount of flicker that office automation equipment present to a human. Embodied in the IEEE-519 technical specification are recommendations for percent voltage fluctuation limits due to large industrial applications such as electric arc furnaces.

An overview of the proposed European flicker regulations is useful in that very few people in industry within the US are familiar with them. The proposed international standard for flicker, as detailed in the IEC 555-3 document, is applicable to all electrical equipment having a rated input current of up to 16 amps per phase for connection to public low voltage distribution systems of 220v and 250v line-to-neutral at 50 Hz. This standard is intended to reduce lamp flicker on low voltage public power distribution systems due to power transients from appliances such as heaters, dryers, motors, cook stoves, computer peripherals, etc.

The limits of this standard are based mainly on the subjective severity of the flicker imposed on the light from 230V 60 W coiled-coil filament lamps by fluctuations of the supply voltage. 60 W coiled-coil filament lamps were used to create a standard threshold of irritation curve for flicker due to the fact that this particular type of incandescent lamp exhibits the shortest time constant for luminescent changes of lamps in common use for domestic lighting.

The proposed flicker regulations rely on a standard household power distribution impedance model which is defined in the IEC 725 publication. A standard impedance is necessary due to the fact that typical household line impedance vary greatly from country to country as well as dramatically for regions within a country. Also, a standard impedance value gives the same limit condition for appliances manufactured for use in all countries.

The standard impedance for flicker measurements as well as current harmonics measurement is specified by the IEC 725 document as: $Z_f=0.4\Omega+j0.25\Omega$, phase to neutral at 50 Hz for all European communities. Presently this standard reference impedance does not apply to the manufacture of appliances for the US market although the IEC has proposed a standard impedance of $Z_f=0.4\Omega+j0.3\Omega$ phase to neutral at 60 Hz for the United States. All of the flicker measurements illustrated later in this text were performed with a reference impedance of $Z_f=0.4\Omega+j0.25\Omega$ utilizing a printer operating at 120V at 60 Hz.

The standard flicker measurement system for single phase measurements is detailed in FIG. 1 and helps the reader to understand the basics of flicker measurement. From the flicker measurement system presented in FIG. 1 and in later discussion the following definitions are used:

Un Nominal supply voltage.

U(t) The time function of the rms voltage evaluated stepwise over successive half periods of the fundamental voltage.

ΔAU(t) The time function of the change in the rms voltage between periods when the voltage is in a stead state condition for at least 1 second.

$\Delta U_{max}$ The difference between the maximum and minimum rms values of the voltage change characteristic.

$\Delta U_c$ The difference between two adjacent steady state voltages separated by at least on voltage change characteristic.

d(t) The relative voltage change characteristic $d(t)=\Delta U(t)/Un$.

$d_{max}$ Maximum relative voltage change $d_{max}=\Delta U_{max}/Un$.

$d_c$ Relative steady state voltage change $dc=\Delta U_c/Un$.

EUT Equipment under test.

In order to better understand the previously given terms relating to flicker measurement waveforms showing a voltage change characteristic and a relative voltage change characteristic are helpful. The IEC 555-3 document shows example waveforms for both of these cases and they are reproduced in FIGS. 2 and 3.

FIG. 2, as given in the IEC 555-3 document, shows a voltage change characteristic as well as the locations corresponding to the previously defined terms concerning flicker terminology. The time axis of FIG. 2 has been sliced into a histogram corresponding to each half cycle of the AC voltage with the time t1 corresponding to the beginning of the voltage change characteristic. The time t2 is the time at which the maximum voltage change, $\Delta U_{max}$, occurs and the time t3 is the time at which the voltage change characteristic ends. At the end of the voltage change characteristic, t3, the voltage at the terminals of the equipment under test, EUT, has stabilized to the steady state voltage change, $\Delta U_c$. The time from t1 to t3 is considered an evaluation period for a voltage change characteristic.

The measurement of the time function voltage change characteristic at the terminals of the equipment under test, $\Delta U(t)$, is the basis for flicker evaluation. The voltage change $\Delta U(t)$ is due to the change of the voltage drop across the complex reference impedance caused by the complex fundamental input current change of the equipment under test. For any voltage change waveform, $\Delta U(t)$, the relative voltage change waveform, d(t), is given by:

$$d(t)=\Delta U(t)/Un. \qquad \text{eq. 1}$$

The relative voltage change waveform, d(t), is then utilized for assessing the short term flicker, $P_{st}$, and the long term flicker, $P_{lt}$, exhibited by the equipment under test.

The short term flicker value, $P_{st}$, exhibited by the equipment under test may be found through several methods. Flicker can be directly measured with a flicker meter or can be found through simulation given a defined voltage change characteristic, U(t). Flicker can also be found through use of the IEC 555-3 defined threshold of irritability, "$P_{st}=1$", curve if the voltage change characteristic is rectangular. Flicker can also be measured through the use of an analytical method for voltage change characteristics which occur less than 1 per second.

The standard evaluation time for short term flicker is for an interval of ten minutes. Short term flicker is measured from the time the device under test is initially turned on until the end of the evaluation period of ten minutes.

Direct measurement of flicker may be performed with a flicker meter that conforms to the specification given in the IEC 868 technical report on the evaluation of flicker severity. This specification takes into account the mechanisms of vision and the psycho-physiological human studies utilizing a multi-point cumulative probability function for evaluating flicker levels. Computer simulation programs which implement the cumulative probability function described in the IEC 868 document may be used to estimate flicker with a given relative voltage change waveform, d(t). An example is cited in the proposed IEC 555-3.

For rectangular voltage change characteristics the "$P_{st}=1$" curve may be used to evaluate short term flicker The $P_{st}=1$ curve, which is an amalgam of several human visual psychophysiological experiments, shows the relationship between the percent voltage change, voltage change repetition rate and the average human visual flicker threshold of annoyance. For reference the $P_{st}=1$ curve is reproduced in FIG. 4.

As an example of the use of the $P_{st}=1$ curve for rectangular voltage changes suppose the nominal supply voltage is 220 Vrms and a rectangular voltage fluctuation of $\Delta U(t)=3$ Vrms occurs at a rate of 100 times per minute due to a resistive heating load switching in and out of circuit. Utilizing equation 1 the relative voltage change waveform is $d(t)=3/220$ or 1.36% at 100 times per minute. From the $P_{st}=1$ curve of FIG. 4 we find that for 100 variations per minute the threshold of annoyance is 0.7%, this quantity is referred to as $d_{lim}$. The short term flicker value, $P_{st}$, corresponding to the voltage change d(t) is:

$$P_{st}=d(t)/d_{lim} \qquad \text{eq. 2}$$

which yields a short term flicker, $P_{st}$, of:

$$d(t)/d_{lim}=1.36/0.7=1.94. \qquad \text{eq. 3}$$

This flicker level greatly exceeds short term flicker limits and the equipment under test that produces this level of short term flicker would need redesign.

When using the analytical method to evaluate short term flicker, $P_{st}$, a flicker impression time, $t_f$, in seconds is obtained for each relative voltage change characteristic within the observation period of ten minutes. A graphical representation of flicker impression times verses percent relative voltage change is given in the IEC 555-3 document and reproduced in FIG. 5.

It is more convenient for calculation purposes to use an analytical equation and an equation for calculating flicker impression times is given in the IEC 555-3 document as:

$$t_f=2.3(F^*d_{max})^{3.2} \qquad \text{eq. 4}$$

where $d_{max}$ is the maximum relative voltage change as a percentage of the nominal voltage and F is the shape factor associated with the shape of the voltage change waveform.

The sum of the flicker impression times, $\Sigma t_f$, of all evaluation periods within a total observation period $T_p$, in seconds, is the basis for the $P_{st}$ evaluation. Short term flicker is then calculated from the sum of the flicker impression times by the following equation:

$$P_{st}=(\Sigma t_f/T_p)^{(5/6)} \qquad \text{eq. 5}$$

Shape factors are used to convert relative voltage change waveforms, d(t), into a flicker equivalent relative step voltage change ($F^*d_{max}$). This is accomplished by equating the area of the voltage change waveform to the equivalent area of a relative step voltage change.

The IEC 555-3 document provides several plots detailing shape factors for motor-start characteristics, rectangular and triangular voltage characteristics and double step and ramp voltage characteristics. The shape factor for a ramp voltage characteristic is reproduced in FIG. 6 as it is of special interest later in the design of a low flicker, universal fuser, temperature control system.

From observing the shape factor curve for a ramp voltage characteristic of FIG. 6 it is apparent that the highest benefit for flicker reduction is gained if it is possible to implement a ramp voltage change characteristic which exceeds 1 second in ramp time, T. A ramp characteristic which yields a voltage change characteristic over at least 1 second yields a shape factor, F, of 0.2. This knowledge will prove useful later in the design of the power control software which will be coupled with a new power control topology to be presented below.

Long Term flicker is found by continuous measurement of the voltage change characteristic with a flicker meter for 2 hours. Internally the flicker meter is taking 12 ten minute short term flicker readings and then performing a cubic law smoothing operation. Long term flicker can also be determined through the analytic method utilizing the cubic law smoothing operation equation as given in the IEC 868 document as:

$$P_{lt}=\sqrt[3]{\frac{\sum_{i=1}^{N} P_{STi}^{3}}{N}} \quad \text{eq. 6}$$

In the case for the standard measurement of long term flicker N is set to 12 so that 12 ten minute short term flicker observations are cubic law smoothed together to yield a two hour long term flicker value. This equation is also implemented in an IEC 868 conformant flicker meter for calculation of long term flicker values.

The IEC 555-3 document specifies the following limits for voltage fluctuations and flicker as measured at the terminals of the 220v equipment under test.

Short term flicker, $P_{st}$, shall not exceed 1.0.

Long term flicker, $P_{lt}$, shall not exceed 0.65.

Relative steady state voltage change, dc, shall not exceed 3%.

The maximum relative voltage change, dmax, shall not exceed 4%.

The value of d(t) during a voltage change shall not exceed 3% for more than 200 mS.

The standard time interval for short term flicker, $P_{st}$, measurement is 10 minutes.

The standard time interval for long term flicker, $P_{lt}$, measurement is 2 hours.

NOTE: These limits are for 220v equipment and no limits have been proposed for the 120v equipment for use in the United States.

Further test conditions for the measurement of short term and long term flicker are specified in the IEC 555-3 standard for all standard household appliances, office automation equipment, and various other electrical equipment.

An objective of the present invention is to eliminate or at least dramatically reduce the flicker exhibited by the fusing systems of electrophotographic printers and copiers. Briefly restated, flicker is the annoying visual perception of ambient light fluctuations within the home or work place due to large transient power loads inducing voltage sag on the low voltage public power distribution system. An important benefit of the implementation of the flicker solution described herein is the automatic attainment of a universal fuser.

The power control design methods described herein solve the flicker problem, yields a universal fusing system, provides linear power control as a function of duty cycle, eliminates virtually all current harmonics, and presents a near unity power factor to the AC power system at low cost.

SUMMARY OF THE INVENTION

The present invention provides a circuit for controlling the temperature of a heat fixing device for use in an image forming apparatus. The circuit has an inductor connected to a power source. The heat fixing device is then connected to the inductor. Next, a capacitor is connected to the inductor and the power source. A switch is connected to the heat fixing device, the power source and a controller. The controller turns the switch off and on by way of a pulse width modulation thereby controlling the temperature. The controller executes a control program to control the pulse width modulation signal to maintain the temperature. The control program may be implemented in a conventional feedback control structure such as a classic proportional-integral, PI, controller. Adaptive control is an additional avenue open to the temperature control system and is a structure that also fits a conventional feedback control system. The inductor and the capacitor have a resonate frequency that is greater than the power supply frequency. Finally, the PWM frequency is greater than the resonate frequency of the tank circuit formed by the inductor and capacitor.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

The present invention is not limited to a specific embodiment illustrated herein. In order to eliminate or at least dramatically reduce the flicker exhibited by an electrophotographic copier or printer (herein referred to collectively as printer) it is necessary to examine the source of flicker. The major source of flicker in an electrophotographic printer is due to excessive power loading when the fusing system is initially energized while in its cold state and then for all repeat energizations while the printer is in operation.

The fusing system under study possesses a 120 V 950 W tungsten filament quartz glass lamp heating element. A non-statistical survey of 10 quartz lamps from fusing systems removed from ten 115 V printers showed that the average cold resistance of the fuser filament to be approximately 1.49 ohms with a variance of 0.000444 Ω. Due to the low variance of the filament resistance it is assumed that all measurements for one fuser lamp are sufficient.

First, a better understanding of the characteristics of the filament resistance as a function of time when full power is applied to and removed from the filament may aid the reader. The apparatus shown schematically in FIG. 7 was built and allowed the filament current waveform to be measured over time after energizing the filament. From this, a model of the filament resistance when full power is applied to the lamp was constructed.

The current sense resistor R1 in the test fixture was chosen to allow a large enough voltage to be generated by the resulting current for measurement while at the same time minimizing the power reduction in the filament due to current sensing while the filament resistance increased.

Figure 1:
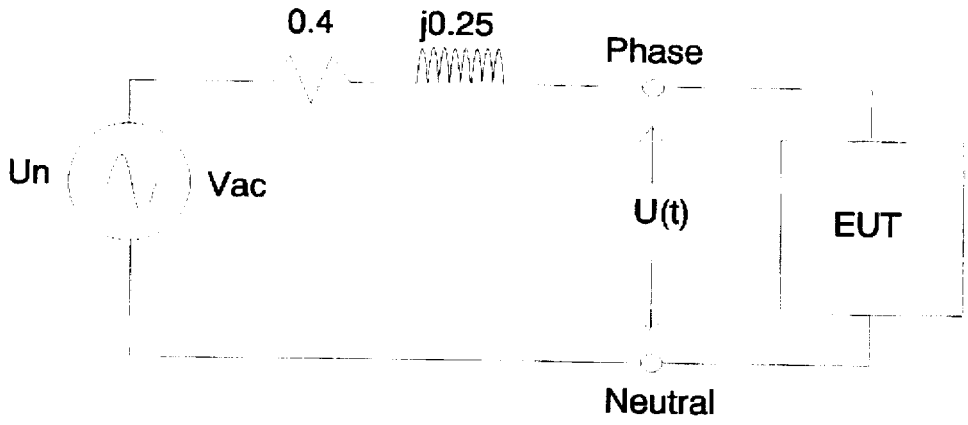
FIG. 1 is a standard flicker measurement model for single phase systems.
Figure 2:
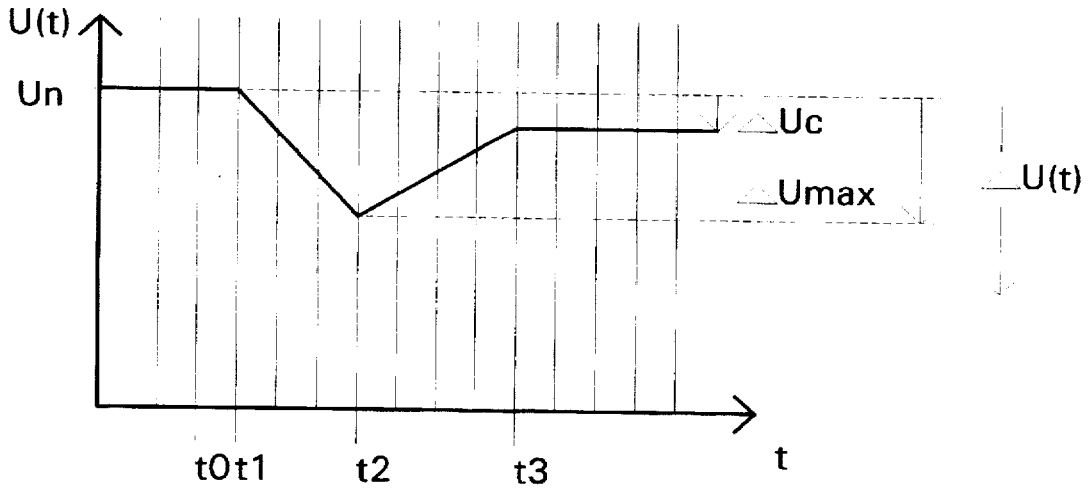
FIG. 2 shows the Voltage change characteristic.
Figure 3:
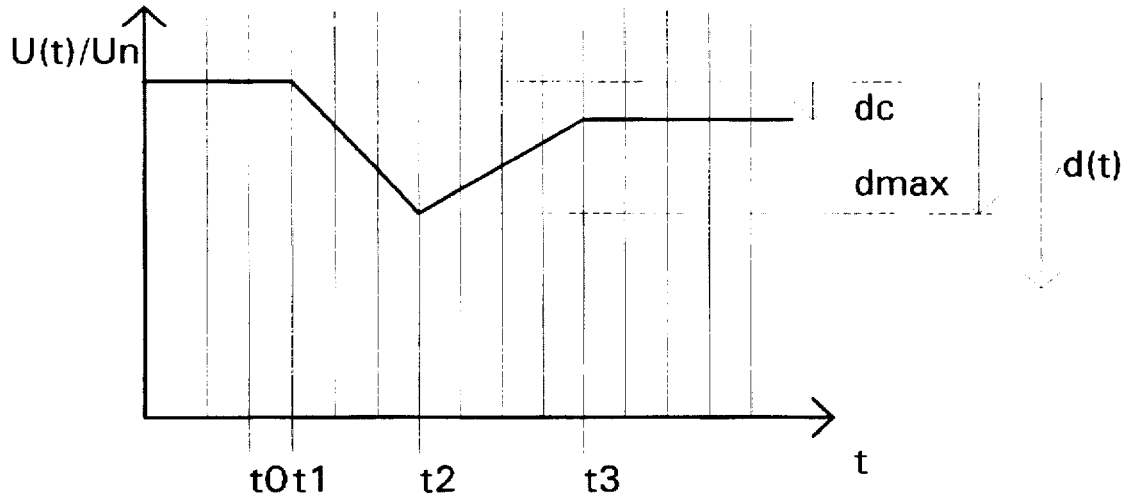
FIG. 3 shows relative voltage change characteristic.
Figure 4:
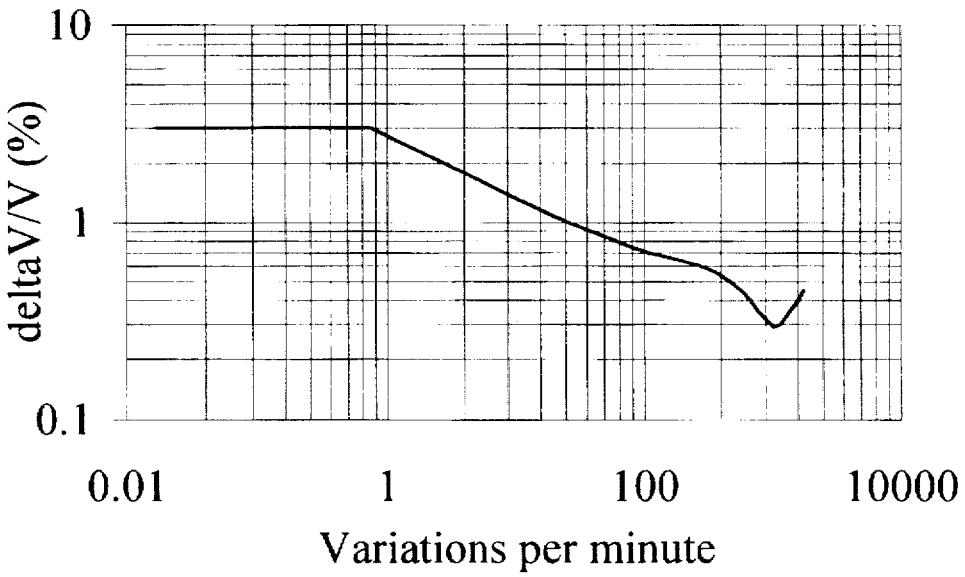
FIG. 4 shows the threshold of annoyance "$P_{st}$=1" curve.
Figure 5:
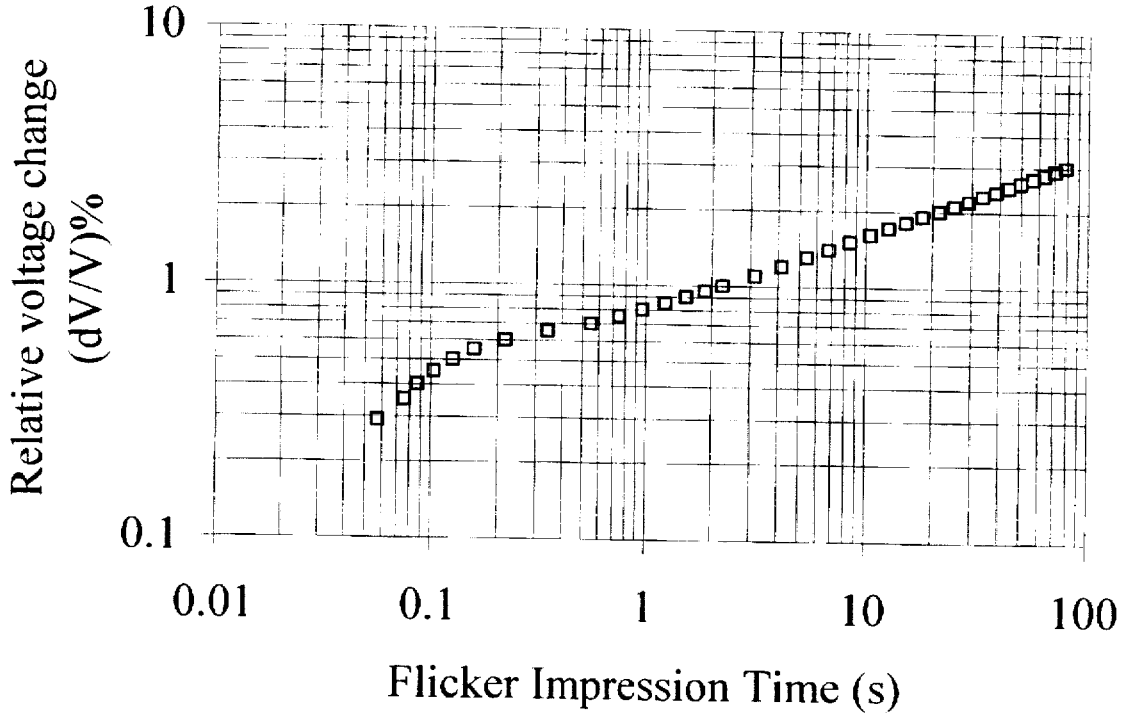
FIG. 5 is a graph of flicker impression time as a function of percent relative voltage change.
Figure 6:
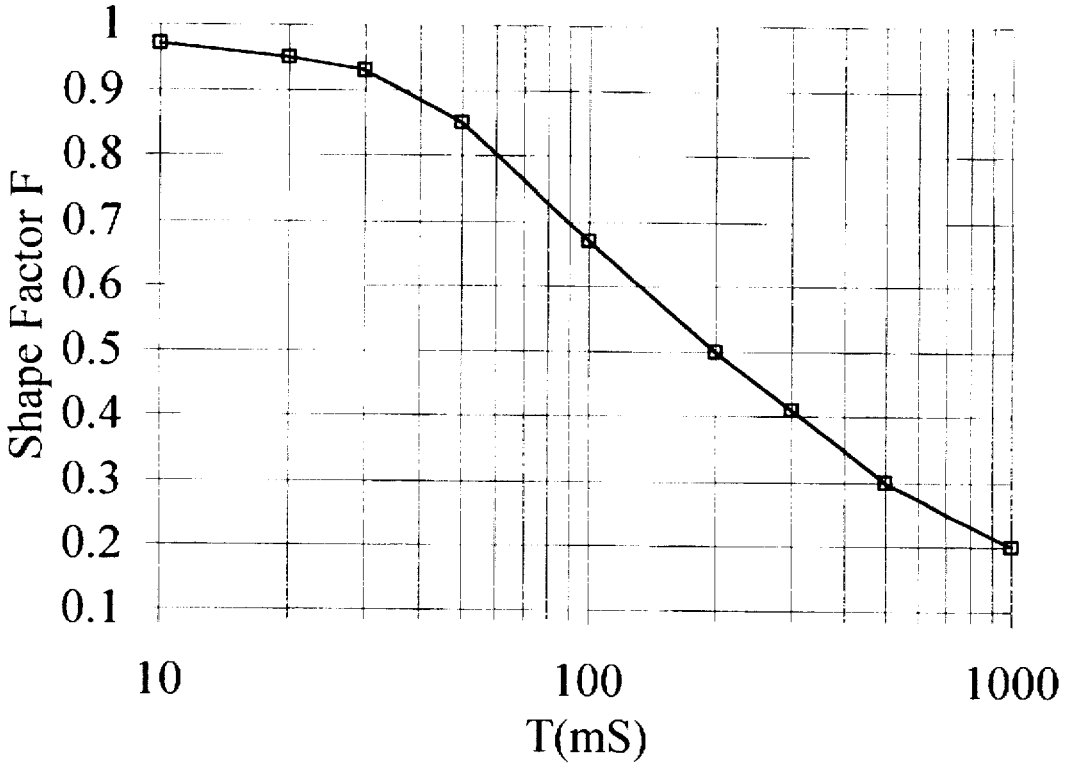
FIG. 6 graphically shows the shape factor for a ramp voltage characteristic.
Figure 7:
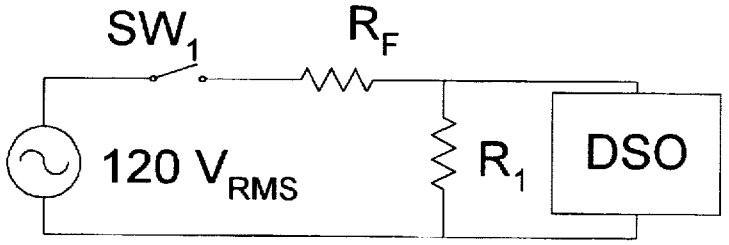
FIG. 7 is a schematic diagram of a test apparatus for characterization of filament 'heating up' resistance curve.

Utilizing the test circuit of FIG. 7 the filament was energized by a 120 Vrms source for approximately 3 seconds while recording the current waveform with a digital oscilloscope (DSO). Three separate tests, with appropriate cooling time between, gave essentially identical curves for the filament current although there was some error in the current sensing voltage measurement due to common mode ac noise on the digital sampling oscilloscope test probe as well as some slight change in the cold filament resistance from 1.5 Ω to 1.8 Ω. The slight change in cold resistance is due to not allowing sufficient cooling time between tests. This value also includes all of the fuser power wiring resistance was found to be approximately 0.13 Ω.

This non-exhaustive test showed that a simple first order model fits the heating up resistance curve very well. This model is in the form of:

$$R=R_{cold}+(R_{hot}-R_{hot}*(1-e^{-t/\tau up})), \quad \text{eq. 7}$$

where $R_{cold}$ is the cold resistance of the filament, $R_{hot}$ is the hot resistance of the filament and τup is the measured time constant as the filament heats up.

By direct calculation from the measured data the "full power" resistance curve for the filament when connected to a 120 Vrms source is:

$$R=1.8\Omega+(10-10*(1-e^{-t*.003}))\Omega \quad \text{eq. 8}$$

where t is in milliseconds.

The test also shows that for the particular tungsten filament quartz lamp used, a Toshiba 115 V 950 W quartz lamp, that the hot resistance was 6.5 times the cold resistance if the lamp was only energized for a few seconds from a 120 Vrms source. The measured resistance change factor for very short energizations of the tungsten filament is very close to the factor given in the Metallurgist's Handbook.

Additional measurements of the filament resistance were performed while the printer was printing at normal operating temperatures in order to understand how the cold filament resistance changes when the printer is printing and the fusing system is at operating temperatures. The curve shown in FIG. 8 was obtained by measuring the current peaks and voltage peaks while the filament was heating up under the standard triac power controller with the fusing system at operating temperature. Since the filament is almost purely resistive measuring peak current and voltage peaks is a very good method of measuring the filament resistance. The printer was allowed to print continuously for 5 minutes at its rated speed of 10 pages per minute before measurement. The printer was printing on standard 20 pound bond letter size paper with 5% toner coverage.

Viewing the operating temperature filament resistance from FIG. 8 shows again that a single time constant model fits the warm energization filament resistance curve very well. The equation governing filament resistance for this warm energization was found by direct calculation to be approximately:

$$R=5\Omega+(9-9*(1-e^{-t*0.378}))\Omega \quad \text{eq. 9}$$

where t is in seconds.

When comparing the time constant for the heating resistance characteristics for the cold filament as well as the warm filament it is interesting to note that there is very little change in the filament time constant for cold or warm energizations.

Figure 8:
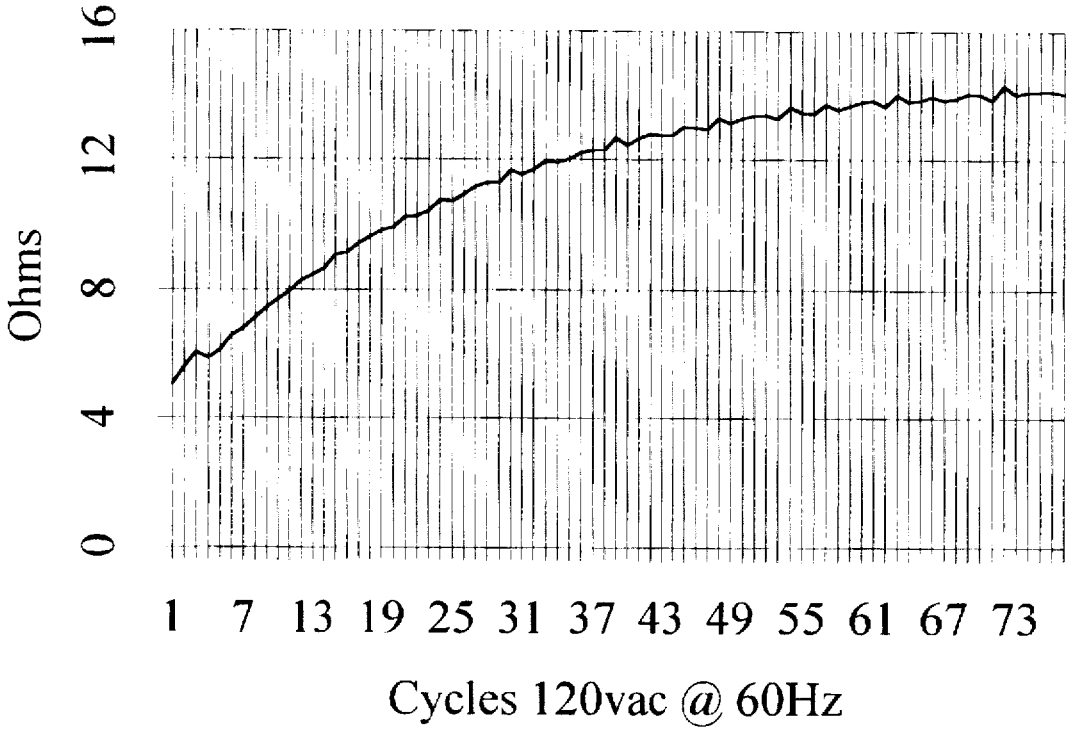
FIG. 8 is a graph showing a resistance curve for warm filament energized at full power.

Notice, while viewing FIG. 8, that when power is applied that the filament resistance is already at 5.2 Ω. This is due to the fact that it has been approximately 10 seconds since the filament was last energized and the filament resistance has dropped from 14 Ω to 5.2 Ω during the 10 seconds of off time. As repeated filament energizations draw significantly lower peak currents than the initial energization the induced voltage change characteristic on a reference impedance decreases thus reducing the flicker exhibited by the now warm fusing system.

Figure 9:
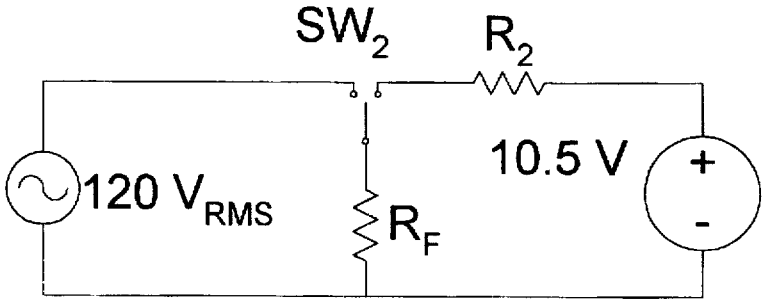
FIG. 9 is a schematic diagram of a test apparatus for characterization of hot filament 'cooling' resistance curve.

It was also of interest to understand the filament resistance as a function of time when full power is removed. The very simple test circuit, detailed in FIG. 9, was assembled and allowed the filament to be heated to full power and then switched (SW2) into a voltage divider network. The 10.5 Vdc test measurement voltage and the voltage divider resistor R2 of the test circuit were chosen to minimize errors to the filament resistance profile from additional energy being delivered to the filament by the test apparatus. After the filament is switched from the AC power source to the DC test source the maximum power delivered to the filament is:

$$P_{filament} = \frac{V^2 \cdot R_{filament}}{(R_{filament} + 100.4\ \text{ohms})^2}. \qquad \text{eq. 10}$$

Utilizing equation 10 with a test voltage of 10.5 V, a voltage divider resistor R2 of 100.4 Ω, and an assumed filament resistance of 14 Ω shows that the test apparatus is supplying 118 mW of power to the filament when the filament is first switched into the test circuit. After the filament has cooled and its resistance has decreased to approximately 3 Ω we find that the test apparatus is now supplying only 31 mW of power to the filament. These very low power levels will not significantly alter the filament resistance profile of the 950 W lamp.

Figure 10:
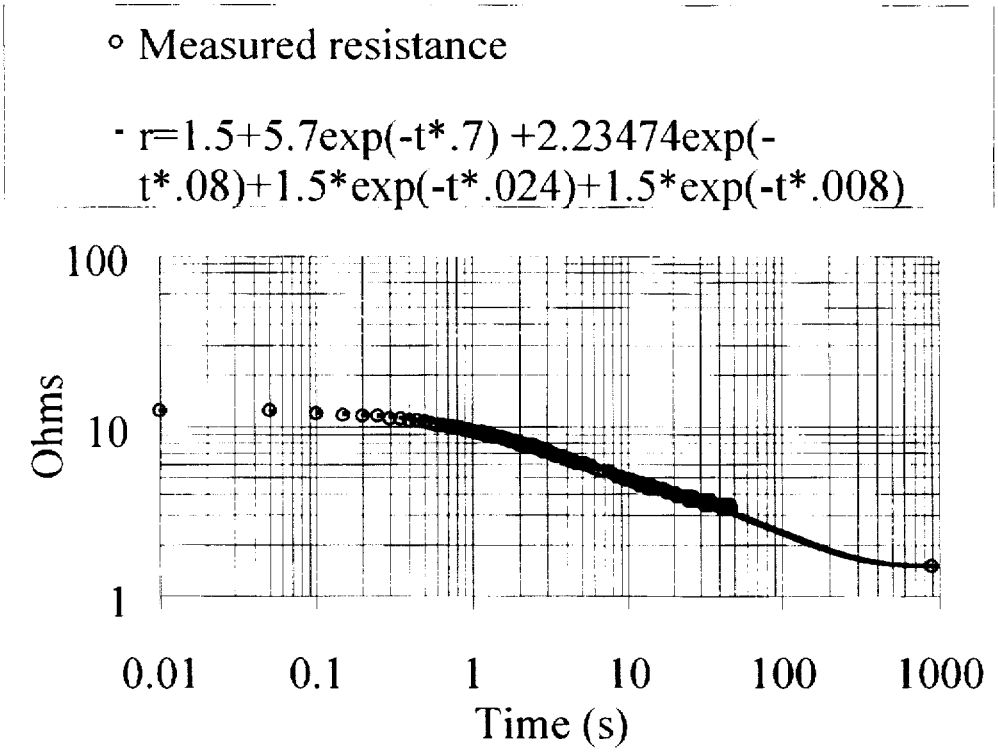
FIG. 10 graphically show hot filament cooling resistance verses time.

The voltage across the filament verses time profile was recorded and from this information a resistance profile was created and then modeled. The measured data for the cooling filament resistance as well as the modeled resistance are given in FIG. 10.

Based on the information gathered while modeling the cooling filament resistance, the cooling filament resistance appears to follow four discrete curves. The first resistance trajectory is followed as the filament is cooling down from intense white hot to red hot. The second trajectory appears to dominate as the filament continues to radiate from red hot to deep red. The third trajectory appears to dominate as the filament radiates from the deep red into the infrared region and the final trajectory dominates as the filament radiates through the infrared region to room temperature. Again a simple model can be used to describe the resistance of the filament as it cools down.

The cooling filament resistance model is in the form of:

$$R = Rcold + (\Delta r_1 e^{-t/\tau 1}) + (\Delta r_2 e^{-t/\tau 2}) + (\Delta r_3 e^{-t/\tau 3}) + (\Delta r_4 e^{-t/\tau 4}), \qquad \text{eq. 11}$$

where Rcold is the cold resistance, $\Delta r_1$ is the change in resistance as the filament cools from white hot to red hot, $\tau_1$ is the time constant associated with the $\Delta r_1$ drop, $\Delta r_2$ is the resistance change from as the filament cools from red hot to near infrared, $\tau_2$ is the time constant associated with the $\Delta r_2$ drop, $\Delta r_3$ is the resistance change from near infrared to infrared, $\tau_3$ is the time constant associated with the $\Delta r_3$ drop, $\Delta r_4$ is the resistance change as the filament finishes cooling through the infrared region to near room temperature and $\tau_4$ is the time constant associated with the $\Delta r_4$ drop.

The empirical model extracted from test data for the cooling filament resistance was found to be:

$$R = 1.5 + 5.7 * e^{-(t*0.7)} + 2.2345 * e^{-(t*0.08)} + 1.5 * e^{-(t*0.024)} + 1.5 * e^{-(t*0.008)} \qquad \text{eq. 12}$$

This tungsten filament model is greatly influenced by the energy loss mechanisms of the refractory metal of the filament as well as the thermal mass and ambient temperature of the fuser platens. The first two time constants appear to depend on the energy loss mechanisms of the tungsten filament and the final two time constants appear to be dominated by the stored heat in the thermal mass of the fuser platens and would be much different for a free standing incandescent lamp. Because the present invention is interested in the resistance characteristics of the fusing system as a whole, no resistance measurements were made of just the quartz lamp independent of the fusing system thermal mass. It is sufficient to note that the thermal mass of the fuser platens contributes greatly to the characteristic of the cooling tungsten filament resistance and dominates when the filament is no longer visibly glowing and yields an extremely long time constant.

It was observed that the skin effect of tungsten was starting to become important at the intended 20 KHz operating frequency of a filament switch mode type power controller. At a 20 KHz switching frequency the self inductance of the cold filament starts to drop but the positive temperature coefficient of the tungsten helps to reduce the contribution of the skin effect and restore the filament self inductance when the filament has warmed to near operating temperatures.

In order to meet all requirements, the preferred embodiment uses a switch mode converter. First, lets examine briefly several standard power control topologies. Next, the preferred embodiment of the present invention, which attempts to address all of the issues for a flicker free universal fuser, is introduced. Impedance based analysis techniques are introduced as well as methods for component type and value selection. Finally, an investigation of the physical operation of the preferred embodiment is covered.

Figure 11:
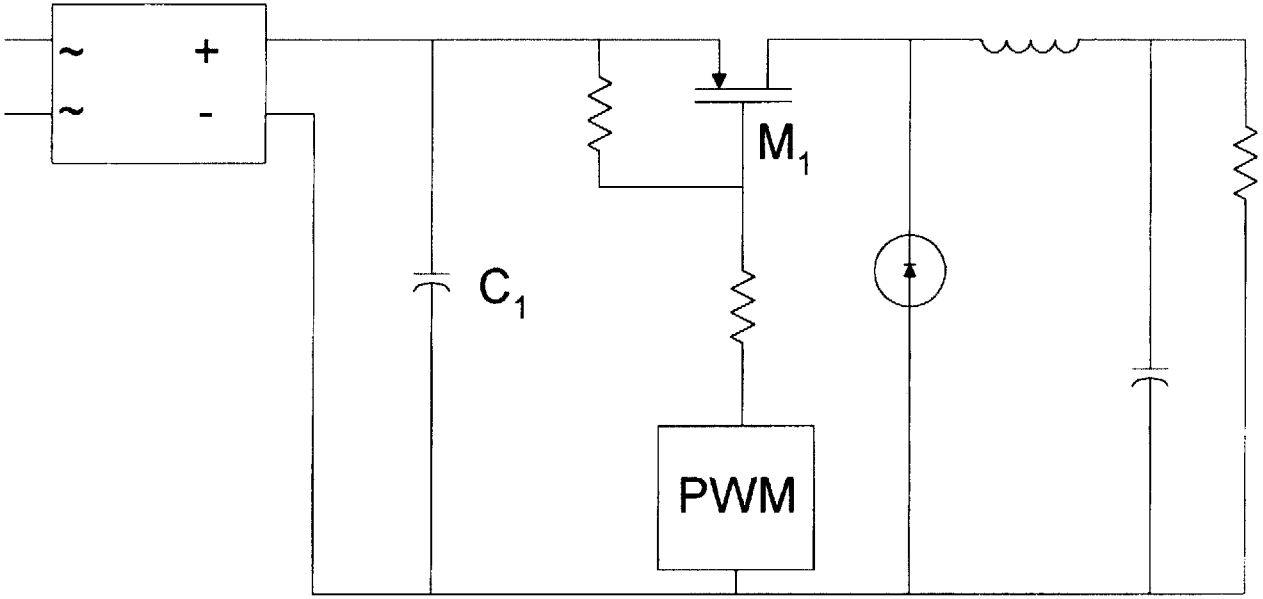
FIG. 11 is a schematic diagram of standard "Buck" DC-DC converter.

The standard buck converter of FIG. 11 is attractive in that the average voltage presented to the filament is a linear function of the voltage of the power source and the duty cycle of the pulse width modulator. This allows the average filament power level to be easily controlled and the filament can be completely powered down by turning off the pulse width modulator. However, the large input capacitor C1 of the standard DC-DC buck converter eliminates the possibility of unity displacement power factor for any load as well as causes the converter to produce large amounts of current harmonics which are dramatically affected by the duty cycle of the converter. Due to the large current switching transients the standard buck topology also presents problems with meeting conducted and radiated emissions requirements. The requirement of a PMOS or PNP type switch M1 for grounded load off-line connection also limits the efficiency of the converter. Of course the standard buck converter could be rearranged such that current is switched on the low side rather than the high side so that an N type switch could be utilized but this would place a dangerous high DC voltage on the filament at all times unless an electromagnetic power relay were used to engage the positive DC voltage when it was desired to power the heating element.

Because of the problems associated with the standard DC-DC buck converter as shown in FIG. 11 is not acceptable for worldwide use for direct control of the large amounts of power required by the fusing system. Additionally due to cost considerations the transformer isolated fly-back and forward buck type converters are unacceptable as well.

Figure 12:
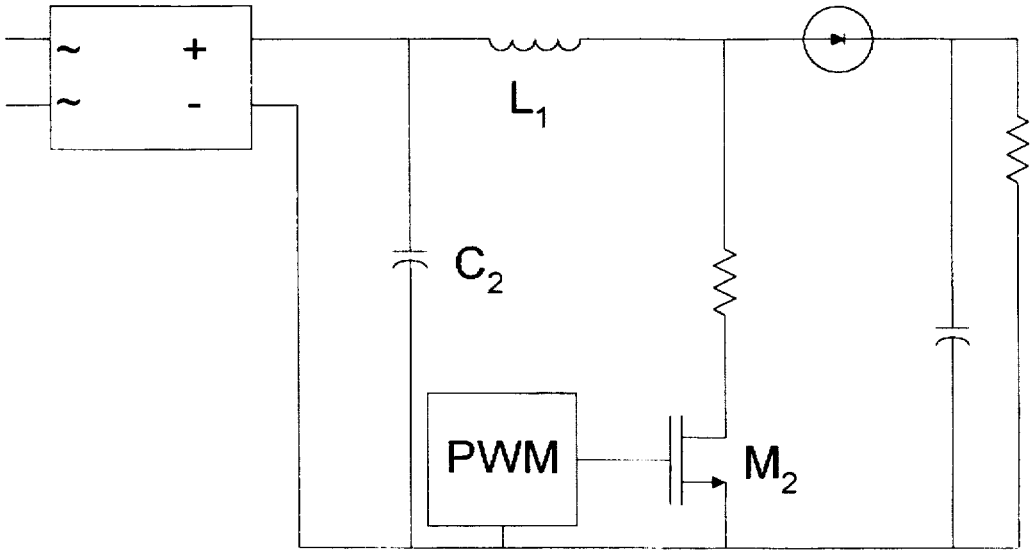
FIG. 12 is a schematic diagram of standard Boost DC-DC converter.

The standard DC-DC boost converter of FIG. 12 has many attractive features. If the input filter capacitor C2 is of minimum size the input to the boost converter appears as an inductor. If the boost converter is designed such that the input inductor L1 is always in continuous conduction then current harmonics will be placed at the switch frequency and are easily and automatically filtered. The boost converter also typically utilizes an N type switch M2 which is of lower cost and has lower switching losses and lower conduction losses than the P type switch of the buck converter of FIG. 11.

Along with the attractive features of the standard boost converter there are some qualities which lower its attractiveness. The large input capacitance C2, used to supply a nearly constant DC switch voltage, results in a rather poor power factor as well as produces large current harmonics. The boost converter does not exhibit linear load voltage or power control as a function of duty cycle which also limits its attractiveness. The boost converter topology also requires a change from a 115 V rated heating element to a much larger voltage rated heating element to allow for worldwide operation. The high output voltages of the boost converter are also undesired due to the generation of radiated and conducted emissions. High voltage high power MOS power switches are also prohibitively expensive. However, IGBT power switches with their lower cost and higher current surge capacity are available which increases our options for power control. The power to the heating element cannot be turned off by the switch in the boost converter and an additional external switch is necessary.

Figure 13:
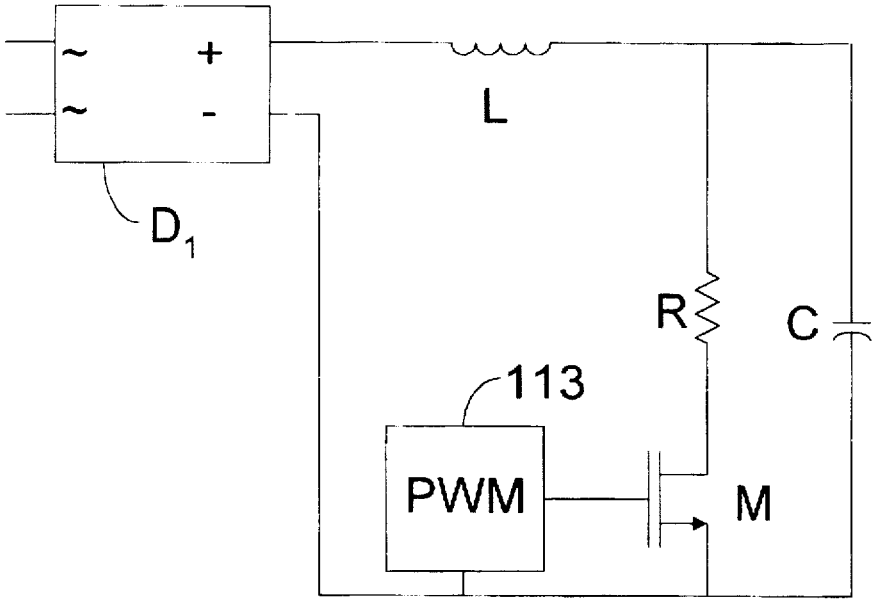
FIG. 13 is a schematic diagram of an embodiment in accordance with the present invention.

The circuit of FIG. 13, which shows a simplified embodiment of the present invention, utilizes the input inductor L of the boost converter topology to average the current drawn by the converter which greatly reduces the current harmonics that are presented to the AC line. Switching the load in an out of circuit draws on a variation of the buck converter topology. This topology linearly controls the average current drawn by the load R and thus the average power drawn by the load varies linearly with duty cycle. The capacitor C provides a continuous current path for the input filter inductor L current when the filament R is switched M out of circuit by the PWM 113.

Unlike a standard DC-DC voltage converter, which controls a load voltage as its power requirements change by modifying the duty cycle of a pulse width modulator, this converter controls the AC power supplied to a printer fusing system heating element R and hence the temperature of the fusing system.

With properly selected filter components L and C and a large enough resistive power load R, which completely discharges filter capacitor C every half cycle of the input line fundamental frequency causes input inductor L to experience continuous conduction over nearly the entire AC half-cycle, the AC power source essentially sees a resistive load, i.e. a dominant current in phase with the AC voltage source. The result is that a near unity power factor is obtained for a wide range of duty cycles and their associated power levels.

For the new power converter topology the resistive load R is switched into and out of circuit several hundred times per AC half cycle which causes an effective resistive load to appear. To perform the derivation of the effective load, the filter components are removed and the power converter is now the simple case of a pulse width modulated 113 power switch M and a resistive load R connected to a fully rectified sinusoidal AC voltage source.

Figure 14:
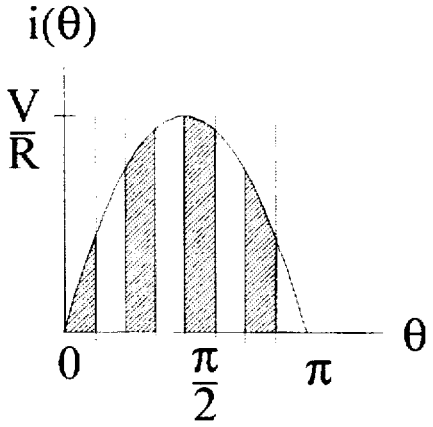
FIG. 14 is an example of a sinusoidal current drawn by a chopped PWM resistive load with duty cycle d.

Consider resistive load R being switched into and out of circuit N times per half cycle by a pulse width modulated 113 switch M of duty cycle d. The case of N=4 and d=0.5 as shown in FIG. 14 helps visualize the pulsed current waveform drawn from a sinusoidal voltage source.

The instantaneous power dissipated by the resistive load R is:

$$Pavg = \frac{1}{T} \cdot \frac{V^2}{R} \cdot \left( \int_0^T \mathrm{Sin}(\theta t)^2 dt \right) \qquad \text{eq. 13}$$

The average power integral is made up of the many intervals during which the resistive load R is switched in circuit, power is consumed, and then switched out of circuit. Because the average power integral includes all of these power pulses an integral summation notation can be used as follows:

$$Pavg = \frac{1}{T} \cdot \frac{V^2}{R} \cdot \sum_{i=1}^{N} \int_0^T a \cdot \mathrm{Sin}(\theta)^2 d\theta \qquad \text{eq. 14}$$

where N is the number of current pulses within the interval of the integral with the variable a equal to 1 when switch M is on and 0 when switch M is off. Setting the integral interval from 0 to π for evaluation of one AC half cycle we can easily find the limits to all of the integrals in the summation form as:

$$Pavg = \frac{1}{\pi} \cdot \frac{V^2}{R} \cdot \sum_{i=1}^{N} \int_{(i-1)\cdot\frac{\pi}{N}}^{(i-1+d)\cdot\frac{\pi}{N}} \mathrm{Sin}(\theta)^2 d\theta. \qquad \text{eq. 15}$$

Substituting in the standard solution to the trigonometric integral and evaluating the limits of the integrals yields:

$$Pavg = \frac{1}{\pi} \cdot \frac{V^2}{R} \cdot \left[ \sum_{i=1}^{N} \frac{1}{2} \cdot \frac{i-1+d}{N} \cdot \pi - \frac{1}{4} \cdot \sin\left(2 \cdot \pi \cdot \frac{i-1+d}{N}\right) - \frac{1}{2} \cdot \frac{i-1}{N} \cdot \pi + \frac{1}{4} \cdot \sin\left(2 \cdot \pi \cdot \frac{i-1}{N}\right) \right] \qquad \text{eq. 16}$$

Gathering like terms results in:

$$Pavg = \frac{1}{\pi} \cdot \frac{V^2}{R} \cdot \left[ \sum_{i=1}^{N} \left( d \cdot \frac{\pi}{2 \cdot N} - \frac{1}{4} \cdot \sin\left(2 \cdot \pi \cdot \frac{i-1+d}{N}\right) + \frac{1}{4} \cdot \sin\left(2 \cdot \pi \cdot \frac{i-1}{N}\right) \right) \right] \qquad \text{eq. 17}$$

Performing the series summation on the non-trigonometric portion yields:

$$Pavg = \frac{1}{\pi} \cdot \frac{V^2}{R} \cdot \left[ d \cdot \frac{\pi}{2} + \left[ \sum_{i=1}^{N} \left( \frac{1}{4} \cdot \sin\left(2 \cdot \pi \cdot \frac{i-1}{N}\right) - \frac{1}{4} \cdot \sin\left(2 \cdot \pi \cdot \frac{i-1+d}{N}\right) \right) \right] \right] \qquad \text{eq. 18}$$

Next recall the double angle sine trigonometric identity, $$\sin(2.\theta) = 2 \cdot \sin(\theta) \cdot \cos(\theta) \qquad \text{eq. 19}$$

Substituting the double angle identity into the equation 18 yields:

$$Pavg = \frac{1}{\pi} \cdot \frac{V^2}{R} \cdot \left[ d \cdot \frac{\pi}{2} + \frac{1}{4} \cdot \left[ \sum_{i=1}^{N} \left[ 2 \cdot \right. \right. \right. \qquad \text{eq. 20}$$

-continued $$\sin\left(\frac{i-1}{N}\cdot\pi\right)\cdot\cos\left(\frac{i-1}{N}\cdot\pi\right)-\left(2\sin\left(\frac{i-1+d}{N}\cdot\pi\right)\cdot\cos\left(\frac{i-1+d}{N}\cdot\pi\right)\right)\Bigg]\Bigg]\Bigg]$$

Which may be rewritten as:

$$Pavg=\frac{1}{\pi}\cdot\frac{V^2}{R}\cdot\left[d\cdot\frac{\pi}{2}+\frac{1}{2}\cdot\left[\sum_{i=1}^{N}\left[\sin\left(\frac{i-1}{N}\cdot\pi\right)\cdot\cos\left(\frac{i-1}{N}\cdot\pi\right)-\left(\sin\left(\frac{i-1+d}{N}\cdot\pi\right)\cdot\cos\left(\frac{i-1+d}{N}\cdot\pi\right)\right)\right]\right]\right] \quad \text{eq. 21}$$

Again recall the following trigonometric identities for addition $$\sin(a-b)=\sin(a)\cdot\cos(b)-\cos(a)\cdot\sin(b)$$

$$\cos(a-b)=\cos(a)\cdot\cos(b)+\sin(a)\cdot\sin(b) \quad \text{eqs. 22 and 23}$$

Substituting the additional identities yields the following rather long result:

$$Pavg=\frac{V^2}{R}\cdot\frac{d}{2}+\frac{V^2}{2\cdot\pi\cdot R}\cdot\left[\sum_{i=1}^{N}\left[\left(\sin\left(i\cdot\frac{\pi}{N}\right)\cdot\cos\left(\frac{\pi}{N}\right)-\cos\left(i\cdot\frac{\pi}{N}\right)\cdot\sin\left(\frac{\pi}{N}\right)\right)\cdot\left(\cos\left(i\cdot\frac{\pi}{N}\right)\cdot\cos\left(\frac{\pi}{N}\right)+\sin\left(i\cdot\frac{\pi}{N}\right)\cdot\sin\left(\frac{\pi}{N}\right)\right)\right]\right]-\frac{V^2}{2\cdot\pi\cdot R}\cdot\left[\sum_{i=1}^{N}\left(\sin\left(i\cdot\frac{\pi}{N}\right)\cdot\cos\left(\frac{-1+d}{N}\cdot\pi\right)-\cos\left(i\cdot\frac{\pi}{N}\right)\cdot\sin\left(\frac{-1+d}{N}\cdot\pi\right)\right)\cdot\left(\cos\left(i\cdot\frac{\pi}{N}\right)\cdot\cos\left(\frac{-1+d}{N}\cdot\pi\right)+\sin\left(i\cdot\frac{\pi}{N}\right)\cdot\sin\left(\frac{-1+d}{N}\cdot\pi\right)\right)\right] \quad \text{eq. 24}$$

Now lets examine the portions of the resulting equation which have sine and cosine terms which are independent of the summation function.

The following sine and cosine functions are independent of the summation variable, i.

$$\sin\left(\frac{-1+d}{N}\cdot\pi\right)\quad\cos\left(\frac{-1+d}{N}\cdot\pi\right) \quad \text{eq. 25}$$

$$\sin\left(-\frac{\pi}{N}\right)\quad\cos\left(-\frac{\pi}{N}\right)$$

$$\sin\left(\frac{\pi}{N}\right)\quad\cos\left(\frac{\pi}{N}\right)$$

For the preceding sine terms if N is much larger than π then the result of the sine operation is very nearly 0. Likewise in the cosine terms if N is much larger than π then the cosine terms evaluate to 1. For the power converter under consideration at a source frequency of 50 Hz and a converter frequency of 20 KHz the number of current pulses in a half period of the 50 Hz cycle is:

$$N=\frac{20000\text{ cycles}}{\text{Second}}\cdot\frac{1\text{ Period}}{\left(\frac{50\text{ cycles}}{\text{Second}}\right)}\cdot\frac{1}{2\text{ Period}} \quad \text{eq. 26}$$

This yields N=200 for a 50 Hz source and N≅167 for a 60 Hz source so the assumptions for the sine and cosine terms are very accurate. Substituting in the approximations for the sine and cosine terms yields:

$$Pavg=\frac{1}{\pi}\cdot\frac{V^2}{R}\cdot\left[d\cdot\frac{\pi}{2}+\frac{1}{2}\cdot\left[\sum_{i=1}^{N}\left(\sin\left(i\cdot\frac{\pi}{N}\right)\cdot\cos\left(i\cdot\frac{\pi}{N}\right)-\sin\left(i\cdot\frac{\pi}{N}\right)\cdot\cos\left(i\cdot\frac{\pi}{N}\right)\right)\right]\right] \quad \text{eq. 27}$$

Inspecting the resulting terms in the series summation shows that the summation results in a value of 0. The result of this exercise is:

$$Pavg=\frac{1}{\pi}\cdot\frac{V^2}{R}\cdot\left(d\cdot\frac{\pi}{2}\right) \quad \text{eq. 28}$$

Which may be rewritten as $$Pavg=\frac{V^2}{2\cdot R}\cdot d \quad \text{eq. 29}$$

This result is identical to that obtained if one were to examine the effective load of the integral half cycle controller over many AC half cycles with the desirable exception that there are no current sub-harmonics present.

Since the voltage, V, in equation 29 is the peak voltage and that the power converter is seeing a sinusoidal voltage source it is given without proof that $V^2/_2$ can be replaced with the equivalent RMS voltage for use in later calculations and yields an average power $$Pavg=\frac{Vrms^2}{R}\cdot d \quad \text{eq. 30}$$

The effective resistive load can be found by equating the average power supplied to a resistive load to that consumed by the duty cycle pulse width modulated resistive load and again it is found that the effective resistive load presented by the power controller to the AC source is:

$$Reff=\frac{R}{d} \quad \text{eq. 31}$$

Thus, as long as the input inductor is always in continuous conduction the AC source essentially sees a resistor whose value is controlled by the duty cycle of the PWM. This feature allows the power controller to smoothly ramp up and ramp down the power consumed by the lamp filament rather than just placing the filament in circuit and letting it draw large currents which would produce the unwanted effect of flicker.

In order to understand why this proposed power control implementation is useful it is best to examine how the low frequency 50 Hz–60 Hz AC power source sees the power converter topology. If the input current filtering inductor is assumed to be in continuous conduction over the entire AC cycle then the bridge rectifier shown in FIG. 13 at the power converter input may be deleted. As was shown above, the pulse width modulated power switch operating at a duty cycle, d, and the resistance associated with the tungsten filament quartz heating lamp can be replaced with an equivalent effective resistance, $R_{eff}$. The result of these assumptions is an equivalent RLC load seen by the AC power source at the phase to neutral connections and is shown schematically in FIG. 15.

Figure 15:
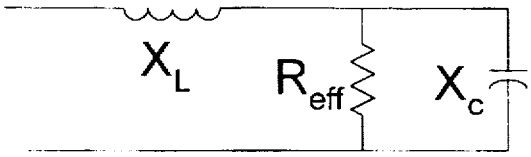
FIG. 15 is a model of the equivalent load "seen" by the AC power source.

If the impedance looking into the phase and neutral connections of the equivalent AC load of FIG. 15 is examined the equivalent load impedance, $Z_{IN}$, can be expressed as $$Z_{IN} = X_L + \frac{R_{eff} \cdot X_C}{R_{eff} + X_C} \quad \text{eq. 32}$$

If $X_L$ and $X_C$ are replaced with their frequency domain equivalents and the frequency of the AC power source is expressed in radians, ω, the load impedance can be expressed as $$Z_{IN} = j \cdot \omega \cdot L + \frac{R_{eff} \cdot \frac{1}{j \cdot \omega \cdot C}}{R_{eff} + \frac{1}{j \cdot \omega \cdot C}} \quad \text{eq. 33}$$

which can be rewritten as $$Z_{IN} = j \cdot \omega \cdot L + \frac{R_{eff}}{j \cdot \omega \cdot C \cdot R_{eff} + 1} \quad \text{eq. 34}$$

If the magnitude of the resistive portion of the load is much less than the magnitude of the impedance of the capacitive portion $$R_{eff} \ll \left| \frac{1}{j \cdot \omega \cdot C} \right| \quad \text{eq. 35}$$

then the AC load impedance can be accurately approximated by $$Z_{IN} = j\omega L + R_{eff} \quad \text{eq. 36}$$

If the magnitude of the resistive portion of the load is much larger than the magnitude of the impedance of the inductive portion $$|j \cdot \omega \cdot L| \ll R_{eff} \quad \text{eq. 37}$$

then the load "seen" by the AC power source becomes $$Z_{IN} = R_{eff} \quad \text{eq. 38}$$

The desire to have an equivalent AC load that is almost purely resistive leads to the following design criteria in the selection of the AC power filter components $$|j \cdot \omega \cdot L| \ll R_{eff} \ll \left| \frac{1}{j \cdot \omega \cdot C} \right| \quad \text{eq. 39}$$

the resistive load, $R_{eff}$, can be replaced with the duty cycle dependent resistive load $$|j \cdot \omega \cdot L| \ll \frac{R}{d} \ll \left| \frac{1}{j \cdot \omega \cdot C} \right| \quad \text{eq. 40}$$

The selection of the values of filter inductor L and capacitor C must take into account the range over which the resistive load may change for various power levels. By separating the impedance's of the respective components of the power control topology by at least one order of magnitude will allow the impedance of the power controller to appear as a resistive load to the AC power source. It is shown later that at low power levels when the magnitude of the effective resistance of the load and the power switch duty cycle, $R_{eff}$, starts to become comparable to the magnitude of the filter capacitor the criteria of equation 39 are no longer satisfied and power quality starts to suffer.

In order to reliably control the power levels associated with the electrophotographic printer fusing system, approximately 950 W, special attention to the selection of the components is necessary. Selection of the filter components must also take into consideration the necessity of controlling the current harmonics, the input power frequency, the switching frequency as well as the cost of the filter components.

The first component to consider is power switch M. Power switch M experiences very high current pulses when the cold heating filament of the fusing system is initially energized as the filament resistance is in the order of 1.5 Ω. For a 120 Vrms system the magnitude of the current pulse will be in the order of ✓2*120V/1.5 Ω or approximately 113 amperes. The magnitude of this initial current pulse is doubled when the power controller is connected to a 220 Vrms supply. These large current surges require a very robust switch, or at a minimum a switch that has a large current rating for short transient currents. The parasitic inductance of the power wiring and the heating filament help to reduce the magnitude of the current pulses and again additional bulk inductance may be added to limit the magnitude of the current pulses experienced by the power switch when the cold heating filament is first energized at low duty cycles. When the heating element is up to operating temperatures the filament resistance will be in the order of 13 Ω which will necessitate a power switch capable of carrying a continuous current of at least 9 amperes.

Power switch M must also be able to withstand high voltages in the off state. Worldwide there is wide variability in the public low voltage supply voltages which may range from 90 Vrms in Japan to a maximum of 240 V in parts of Europe. For the worst case power switch M must be able to withstand peak voltages of ✓2*240 or approximately 339 volts. It may also be appropriate to protect the switch against over-voltage transients with a MOV device either in parallel with the switch or across the filter capacitor. Specification of a MOV device is more appropriate for an actual production version design and will not be dwelt on here.

To limit power dissipated by power switch M the "on-voltage" or "on-resistance" should be chosen to be as low as economically possible. To limit power dissipated by the switch during the turn-on and turn-off transitions the switch should also be specified for the smallest turn-on and turn-off times as possible.

One possible switch that satisfies all the requirements is a Motorola MTY30N50E N-channel power MOSFET transistor. This switch is specified with an on resistance, Rds, of 0.15 Ω, is capable of a continuous current load of 30 amperes and can withstand a minimum of 500 volts in the off state. This device can carry 86 ampere repetitive current pulses and switches from the on and off states in approximately 100 nS. This device is also rated for continuous power dissipation of over 300 W when properly connected to a heat sink While this device is well suited for operating on a 120 Vrms supply it can not handle the current surges anticipated on a 220 Vrms system without bulk inductance in the filament current path. Unfortunately the high current, voltage and power ratings of this switch probably make this device too costly for mass production. A power switch chosen from the insulated gate bi-polar transistor, IGBT, family will be able to meet all of the switch requirements as well as being much more economical. One suitable IGBT switch would be an International Rectifier IRGBC20U rated for 600 Vmax DC operation at 26 A continuous, 184 A peak and rise and fall times of 30 nS and 200 nS respectively.

An anti-parallel filament fly-back diode D2 may be needed to provide a continuous filament current path when the power switch is de-energized. To meet the expected conditions of operation a Motorola MUR1530 ultra-fast diode with a reverse recovery time, $t_{rr}$, of 35 nS was chosen. This particular diode is rated for a continuous current of 15 amperes, can carry repetitive current pulses of 30 amperes and can withstand nonrepetitive surge currents of 150 amperes and withstands a 300 V reverse bias voltage. For use worldwide the reverse bias ratings of the fly-back diode would have to be increased.

For optimal operation current filter inductor L must possess several attributes. Because inductor L handles the full current of the load the first attribute is an extremely low series resistance which is necessary in order to minimize $i^2*R$ losses. The second attribute is that inductor L be relatively small and, for high values of inductance, this necessitates an iron or ferrite core. Thirdly, inductor L must possess a very high saturation current. Input inductor L carries periodic currents in the order of 14 amps peak and must carry this current without saturating. To handle large currents and the resulting magnetic flux densities without saturating dictates that the inductor be constructed with an iron core. Fourth, to minimize conducted emissions the inductor must be designed with the lowest possible interwinding parasitic capacitance. Finally, the inductor core should be designed to minimize core losses.

Filter capacitor C of the new converter topology is subjected to strenuous demands placed on it which affect the capacitor type and ratings that the capacitor must possess. The filter capacitor must be able to withstand continuous voltages in excess of 339 Volts and must withstand repetitive current surges of greater than 160 amperes. The filter capacitor is experiencing repetitive high current surges with each energization and deenergization of the power switch. To avoid excessive power dissipation in and heating of the capacitor, the filter capacitor should exhibit an extremely low equivalent series resistance, ESR. The capacitance exhibited by the capacitor should also remain nearly constant over the entire range of frequencies that it may experience as the duty cycle of the converter changes. In order to meet these requirements a motor run type capacitor is ideal. This type of capacitor is relatively inexpensive, considering its attributes, and is used in large quantity throughout the world for commercial AC motor applications.

The filter components of the new power control topology of FIG. 13 form a resonant tank circuit with a natural frequency, $\omega_o$, of $$\omega_o = \frac{1}{\sqrt{L \cdot C}} \qquad \text{eq. 41}$$

In order to obtain the desired benefit of extremely low harmonic current content the resonant frequency of the power filter, $\omega_o$, must be placed as far away from the input power frequency, $\omega_p$, as possible. Further, to avoid exciting the resonant circuit formed by the power filter components the switching frequency of the power switch, $\omega_s$, should be placed as far away from the power filter resonant frequency as possible. If the resonant frequency of the power filter is placed at least an order of magnitude above the input power frequency and the switching frequency is placed at least an order of magnitude greater than the resonant frequency of the power filter then the proposed power converter topology should have very good control over current harmonics as well as not induce excessive excitation of the power filter tank. These criteria for filter resonant frequency placement are represented as $$\omega_p \ll \omega_o \ll \omega_s \qquad \text{eq. 42}$$

Additionally, in order to present a nearly resistive load to the AC power source the criteria of equation 39 must be satisfied. Recall that the magnitude of the impedance of the input inductor at the frequency of the power source, 50 Hz or 60 Hz, must be much less than the expected resistive load and that the magnitude of the impedance of the filter capacitor must be much larger than the expected resistive load. Equation 39 is reproduced again as the second criteria for filter component selection.

$$|j \cdot \omega \cdot L| \ll R \ll \left| \frac{1}{j \cdot \omega \cdot C} \right| \qquad \text{eq. 39}$$

Equations 41, 42 and 39 form the basis for the selection of the values of the power filter components.

First pass selection of filter capacitor C can be made at very low loads where the power quality starts to degrade. Assume that the power controller is connected to a 120 V source and that it is drawing approximately 30 Watts. This is equivalent to a 500 Ω resistive load and is approximately 40 times the hot filament resistance. If the impedance of filter capacitor C is set equal to the resistive load at this power level a starting value for the capacitor may be found. This is done as follows $$\frac{1}{2\pi \cdot fC} = 500\,\Omega \qquad \text{eq. 43}$$

where f is the frequency of the power source and is assumed to be 60 Hz. Solving for the capacitive value yields C=5.3 μF. A standard commercial value is available at 5 μF.

First pass selection of filter inductor L an be made at any load. A first pass selection will be made by utilizing the previous factor of 40 and setting the impedance of the inductor equal to 1/40 the cold filament resistance as follows $$2\pi \cdot fL = \frac{1.5}{40}\,\Omega \qquad \text{eq. 44}$$

Solving for the inductance yields a value for the inductor of approximately 100 μH. A 150 μH inductor with a saturation current of 14 amperes and a series resistance of 0.004 Ω was readily available so L was specified as 150μH. Actually, the larger that the value of the inductor can be specified the better the resulting filtered current will become. However, in order to avoid unnecessary expense the filter inductor should be as small as possible. Again, in order to minimize conducted emissions the inductor should be designed to have the lowest possible interwinding parasitic capacitance.

The value for the inductor could have been chosen directly from equation 41 by simply specifying the desired resonant frequency of the power filter while making sure that it meets the requirements of equation 42 There are also some tradeoffs in the energy balance stored in the magnetic field of the inductor and the voltage field of the capacitor but these will not be investigated here.

The selected values for filter inductor L and capacitor C yield a resonant frequency of approximately 5.8 KHz which satisfies the requirements of equation 42 although it is a little close to the switching frequency so the tank circuit may experience some excitation.

For worldwide use the bridge rectifier D1 must also be specified appropriately. The voltage rating of the bridge rectifier should be of the same neighborhood as the voltage rating of the power switch. The bridge must also be capable of continuously carrying the largest expected currents when the fusing system is running at full power. To meet these two criteria a bridge rectifier rated at 15 Arms at 600 V was chosen for the construction of the power controller prototype. However, as the diodes of the bridge rectifier do not have to possess fast turn-on/off ratings as the large input inductor of the power filter does not allow fast current pulses through the diodes. This attribute allows less costly rectifiers to be utilized in the input bridge rectifier.

As previously stated any current harmonics that may be present will start at the LC power filter resonant frequency. For the preferred embodiment in FIG. 16, the first current harmonics start near the 116th harmonic for a 50 Hz AC system and the 97th harmonic for a 60 Hz AC system. Other current harmonics start at the switch frequency of 20 KHz which is the 400th harmonic for a 50 Hz AC system and the 333rd harmonic for a 60 Hz AC system. By placing the start of any current harmonics at these high frequencies it is much easier, as well as less costly, to filter any higher order differential or common mode harmonics in order to meet conducted emissions requirements. With the expected small amplitude upper harmonic content and the fact that the component selection meets the requirements of equation 39 for presenting a resistive load to the power source this power control structure will yield a system with the desired high level of power quality, i.e. power factor, over a wide range of duty cycles and power levels.

When the power controller supplied by a 50 Hz or 60 Hz AC power source the components of the power filter LC tank resonant frequency near 5.8 KHz. This is approximately two orders of magnitude above the AC power source frequency and satisfies the requirement of the power filter resonant frequency being at least one order of magnitude above the input power frequency.

With the specified PWM switch frequency of 20 KHz and given that it is desirable to place approximately an order of magnitude between power filter resonant frequency and the switch frequency it would be desirable to either place the power filter resonant frequency several thousand Hz lower or the switch frequency several tens of thousands of Hz higher. A lower power filter resonant frequency would require a larger and more expensive input inductor or a larger and more expensive filter capacitor. Given the limited space available in a typical laser printer it is very undesirable to increase the physical size or cost of the filter components. Further a capacitor much larger than the specified value of 5 μF starts to impact the peak currents drawn by the filter and the power factor of the converter as a whole would deteriorate. It would also be more difficult to completely discharge the filter capacitor with every half cycle of the AC power at lower duty cycles and as we will see later this may affect the switching losses of the switching device. Alternatively, the switch frequency could be placed at 40 KHz or 50 KHz but of course the power switch would start to experience heavier frequency dependent switching losses. Higher switching losses in the power switch are not desirable as the additional energy loss in the form of heat could possibly require more aggressive forced air cooling with the associated expense of a fan.

Unlike a standard DC-DC voltage converter, which controls an output voltage by modifying the duty cycle of the pulse width modulator, this converter is controlling the AC power supplied to an electrophotographic printer or xerographic copier fusing system and hence the temperature of the fusing system. When designing the fuser temperature control program consideration of the change in resistance of the heating filament as it heats and cools and the knowledge of how the human eye perceives flicker will be taken into account.

This preferred embodiment topology allows for the controlled ramping of power to the fuser heating filament. By controlling the ramp rate of the duty cycle of the pulse width modulator this design eliminates the typical inrush current drawn by the cold heating filament. The fact that the magnitude of the current and the rate of change of the current can be controlled very precisely allows this power controller to meet the stated goal of greatly reducing the flicker that the fusing system produces.

When considering the fusing system heating filament this power control topology is essentially a "Buck", or step-down, converter which switches the filament in and out of the AC load in order to control the amount of power supplied to the heating filament. Because this power controller is both a current and voltage step down converter, in which the duty cycle is easily limited, this power controller design will also yield the desired goal of a universal fusing system. The preferred embodiment topology also resembles a boost converter due to the large input inductor as well as a forward converter in that the filament is being energized whenever the power switch is closed. Unlike these other types of converters, in this topology it is desirable to completely discharge the filter capacitor with every half cycle of the AC source. It is also desirable and necessary for the heating element to experience a large ripple current as this topology is controlling the power to the fusing system and its resulting temperature and not a DC voltage or current.

Figure 16:
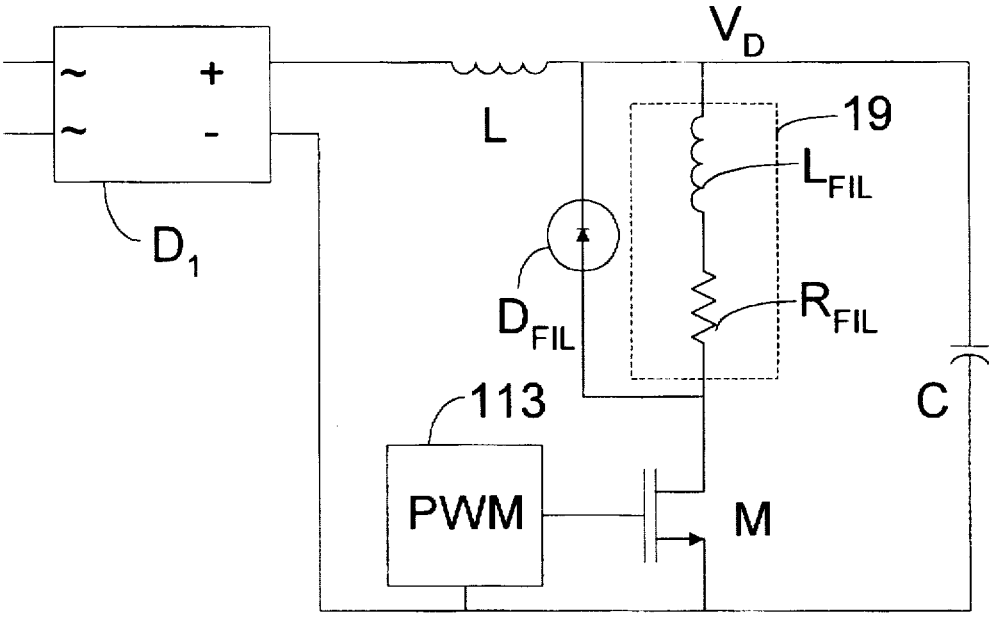
FIG. 16 is a schematic diagram of an embodiment in accordance with the present invention.

With renewed reference to FIGS. 13, 15 and 16, the analysis of the preferred embodiment power control topology starts by examining the associated current paths with the power switch in the conducting and non-conducting states. Assume that the duty cycle of the PWM is at zero and that the filter capacitor is fully charged to the peak line voltage. As the duty cycle of the PWM starts to ramp up, the lamp filament is switched into and out of parallel with the filter capacitor. When the filament is switched into the circuit current starts to flow in the filament, the capacitor starts to discharge through the filament and current starts to flow in the inductor. When the filament is switched out of circuit the flyback diode starts conducting the filament current and the current in the input inductor starts charging up the voltage on the filter capacitor. Before the voltage on the capacitor can increase at the resonant frequency of the power filter tank circuit by an appreciable magnitude and before the current in the inductor can decrease appreciably the filament is switched back in circuit and the process repeats.

Capacitor C is providing energy storage for when the filament is energized as well as a continuous current path for inductor L when the filament is switched out of circuit. Inductor L is averaging the current drawn by the filament such that the AC source essentially sees a very clean, low harmonic content AC current being drawn by the power converter.

Proper filter component selection allows the proposed topology to place an essentially resistive load on the AC power source. It is of interest to examine the impedance as well as the phase angle "seen" by the AC source as a function of duty cycle as the power supplied to the fusing system changes. Previously it was shown that the hot filament resistance is in the neighborhood of 13 Ω. Simulations were performed by replacing the tungsten filament model with a constant resistance of 13 Ω, which is very nearly equal to the filament resistance over a wide range of operating powers.

Utilizing the previous derived equation for converter input impedance from equation 34 for FIG. 15 and substituting the derived equivalent effective resistive load for the pulse width modulated filament yields a load input impedance "seen" by the AC source of:

$$Z_{IN} = j \cdot \omega \cdot L + \frac{\frac{R}{d}}{j \cdot \omega \cdot C \cdot \frac{R}{d} + 1} \quad \text{eq. 45}$$

By multiplying the numerator and denominator of the second term by the complex conjugate of the denominator of the second term, $Z_{IN}$ can be rewritten as:

$$Z_{IN} = j \cdot \omega \cdot L + \frac{R}{d} \cdot \frac{\left(1 - j \cdot \omega \cdot C \cdot \frac{R}{d}\right)}{\left(1 + \omega^2 \cdot C^2 \cdot \frac{R^2}{d^2}\right)} \quad \text{eq. 46}$$

Figure 17:
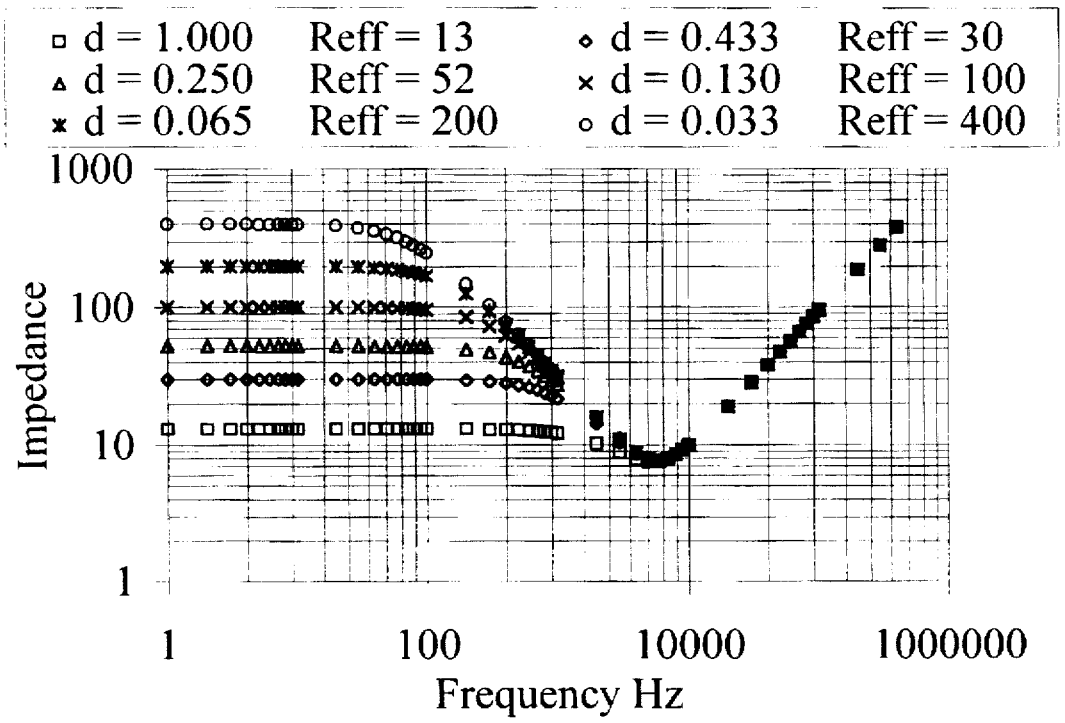
FIG. 17 show a simulation of load impedance "seen" by the AC source as a function of duty cycle.

By utilizing equation 46 and by substituting in the values for the filament resistance and the filter components a simulation of AC load impedance verses duty cycle and angular frequency was conducted and shown graphically in FIG. 17.

For the input impedance the phase angle of the impedance, $\phi$, as a function of duty cycle and angular frequency is found by taking the inverse tangent of the ratio of imaginary to real parts of the impedance and is expressed as:

$$\phi = atan\left(\frac{IM(Zin)}{Re(Zin)}\right) \quad \text{eq. 47}$$

From the previous equation for load impedance separating the real and imaginary parts yields the following equation for the impedance phase angle:

$$\phi = atan\left[\frac{\omega \cdot L - \frac{\omega \cdot C \cdot \frac{R^2}{d^2}}{\left(1 + \omega^2 \cdot C^2 \cdot \frac{R^2}{d^2}\right)}}{\left[\frac{\frac{R}{d}}{1 + \omega^2 \cdot C^2 \cdot \frac{R^2}{d^2}}\right]}\right] \quad \text{eq. 48}$$

Figure 18:
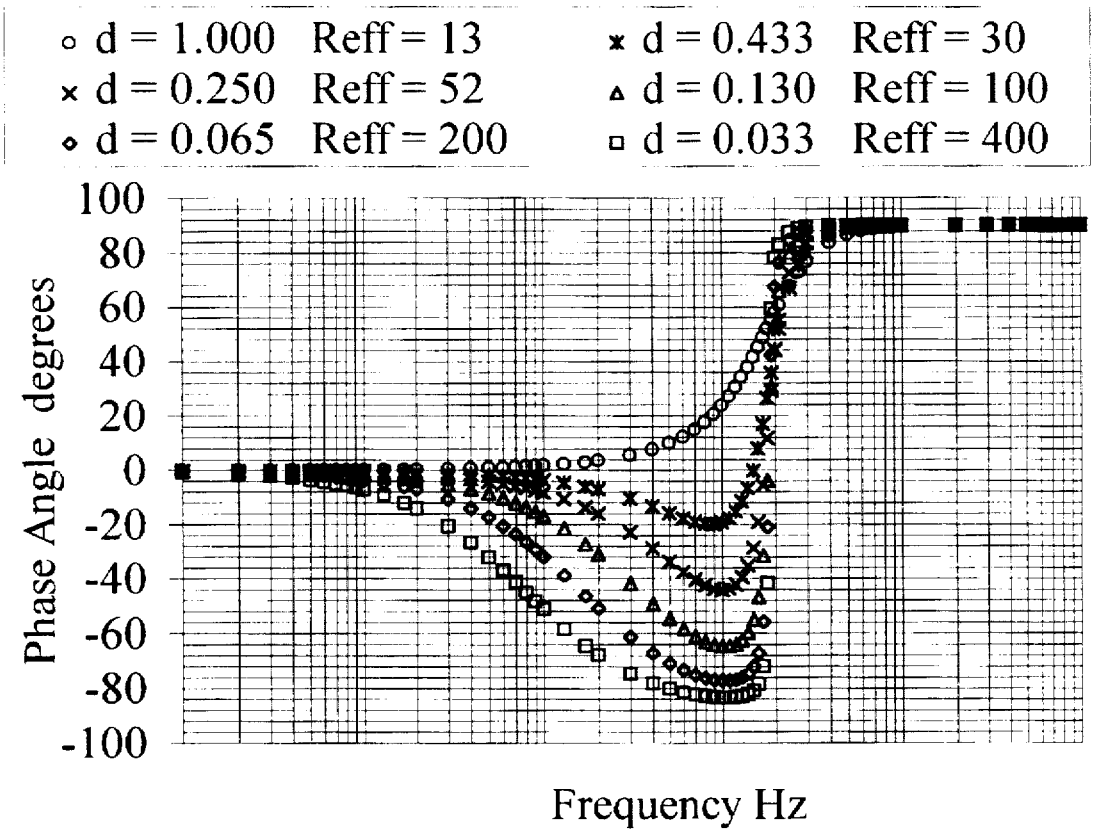
FIG. 18 shows a simulation of load impedance phase angle "seen" by the AC source.

By utilizing equation 48 and substituting in a value for the filament resistance of 13 Ω and filter components of 5 μF and 150 μH a simulation of AC load impedance phase angle verses duty cycle and angular frequency was performed and is given in FIG. 18.

The impedance of the effective load seen by a 50 Hz or 60 Hz AC source as duty cycle is changed is easily found from FIG. 17. The simulation of FIG. 17 shows that for the range of duty cycles, which are required for maintaining temperatures for proper toner fusing, that the new power topology along with the specified components provide an almost purely resistive load to the AC source. The impedance simulation of FIG. 18 confirms this as well. These results show how close to ideal this new power control topology is when coupled with proper filter component selection.

The impedance phase simulation of FIG. 18 also shows that for the specified components that at lower duty cycles and resulting power loads that the impedance of the power control topology starts to appear more capacitive and that the power factor starts to degrade. At these lower duty cycles the effective resistance of the duty cycle modulated heating element becomes large compared to the impedance of the filter capacitor and the criteria of equation 39 are no longer satisfied with proper margin.

The ability to have very good power quality at high loads offsets the loss in power quality at lower loads where power quality is not as important. Of course the filter components can be further optimized to obtain further improvements in the impedance of the load for low duty cycles. With further refinement in filter component selection this topology will allow the AC load to appear almost purely resistive for power levels ranging from below 100 Watts to well over a kilowatt and for AC sources ranging from 50 Hz to 60 Hz and with supply voltages ranging from 90 Vrms to over 240 Vrms.

It is also useful to understand how the power quality, i.e. power factor, of the converter changes as a function of duty cycle. By examining the impedance phase angle "seen" by the AC source from FIG. 18 at the input power frequency of 50 Hz or 60 Hz and assuming that the power quality is only a function of the impedance phase angle will allow the power factor to be simulated as a function of duty cycle.

As long as the power filter inductor is in continuous conduction for nearly the entire AC half cycle the power factor is almost completely dominated by the displacement power factor. Also, as long as the power filter resonant frequency and the filament switch frequency are placed far enough apart then the current distortion due to switching current harmonics will be minimal and the current distortion factor, cdf, will be near unity.

Power factor, PF, is typically composed of the displacement power factor, dpf, multiplied by the current distortion factor, cdf, and is expressed as $$PF = dpf \cdot cdf \quad \text{eq. 49}$$

where the displacement power factor is defined as the cosine of the impedance phase angle, cos($\phi$).

If it is assumed that there is no current distortion (an assumption that will be verified later), i.e. cdf=1, then the power factor is dependent entirely on the displacement power factor and easily calculated from the load impedance phase angle, $\phi$, therefore the power factor will be assumed to be:

$$PF = \cos(\phi) \quad \text{eq. 50}$$

Figure 19:
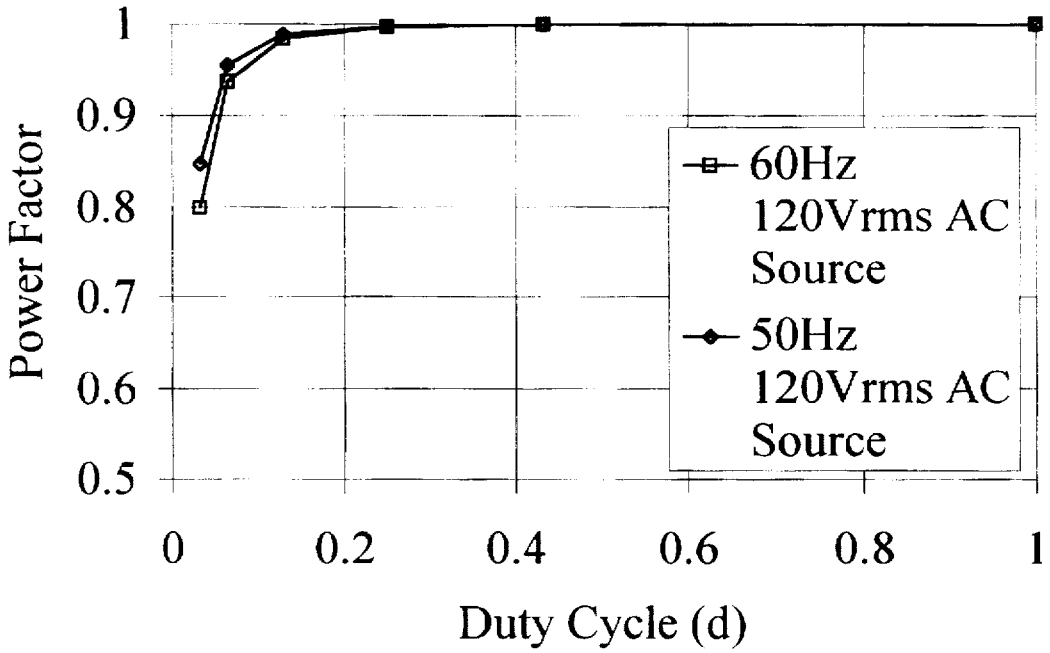
FIG. 19 shows a simulation of load power factor verses duty cycle.

The results of the simulation of power factor verses duty cycle for a 60 Hz AC power source are shown graphically in FIG. 19. Essentially identical results are found for a 50 Hz AC power source and these are also included in FIG. 19. The results of FIG. 19 were found by utilizing equation 48, a power filter inductance of 150 μH, a power filter capacitance of 5 μF and assuming a 13 ohm constant filament resistance for the heating element with the power converter being supplied by a 120 Vrms AC source at 50 Hz and again at 60 Hz Upon reviewing the impedance phase angle and resulting power factor it is apparent that selecting a smaller capacitor for the power filter than specified in FIG. 16 will further improve the power factor at lower duty cycles and associated power levels. A filter capacitor of 3 μF would probably be an excellent choice. Decreasing the filter capacitance would increase the resonant frequency of the power filter. In order to maintain proper separation between the filter resonant frequency and the switching frequency the power filter inductance would have to be increased, by increasing the filter inductance to 300 μH the filter resonant frequency would be shifted a few hundred hertz closer to the input power frequency. The tradeoffs involved are balancing the cost of the filter components and their physical size. Increasing the inductance of a powdered iron core inductor by a few hundred micro-henries can be obtained quite inexpensively with very small impact on its physical size or cost. Decreasing the size of the high power filter capacitor will generally result in a cost savings as well as a sizable decrease in its physical size. Thus reducing the filter capacitance and increasing the filter inductance will be beneficial from a cost standpoint and a physical size standpoint. However, optimizing the design is a subject for future work.

The simulated filament power as a function of duty cycle may be found from equation 30 which is reproduced again as:

$$P_{avg} = \frac{V_{rms}^2}{R} \cdot d \qquad \text{eq. 30}$$

where Vrms is the rms value of the supply voltage, R is the filament resistance and d is the duty cycle of the pulse width modulator.

By utilizing equation 30 and assuming that the source voltage is 120 Vrms and that the filament resistance is 13 Ω we find that the power dissipated by the filament in the previous power factor simulation ranges from 36 W to 1100 W as the duty cycle changes from 0.033 to 1.0. A power factor of 0.8 is achieved at a power level of 36 W and that the power factor is 0.95 when the duty cycle the power level has increased to 72 W. The power factor is essentially unity for all higher power levels.

Power factor measurements were performed on the prototype power converter as duty cycle was varied in order to test the previous hypotheses that the power factor is dominated by the displacement power factor. The power converter and printer fusing system were connected to a 121 Vrms 60 Hz power source and the duty cycle of the PWM was varied manually. The results of the measurement of power factor verses PWM duty cycle are given in FIG. 20.

Figure 20:
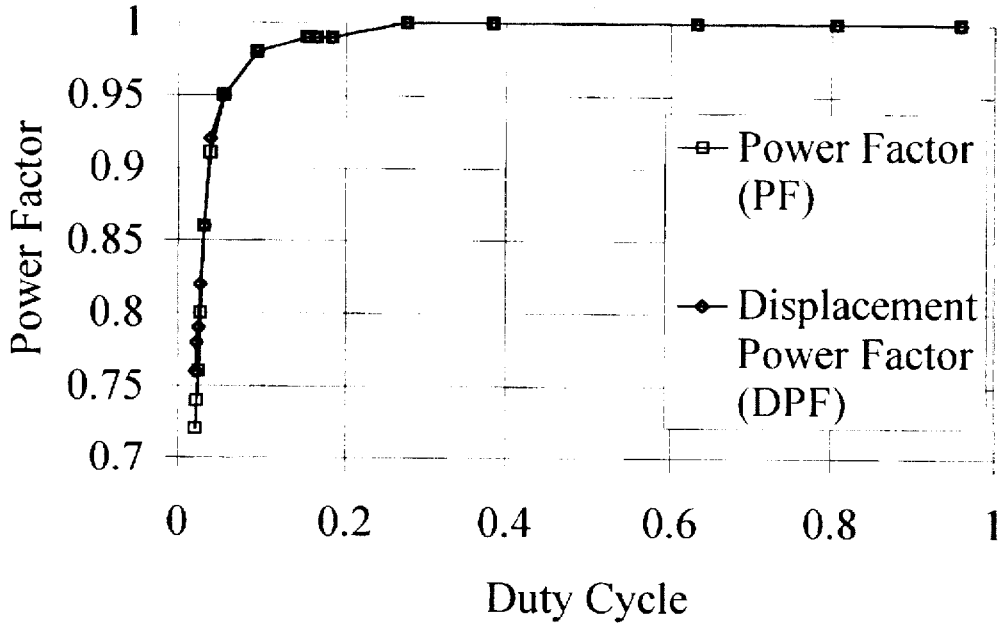
FIG. 20 is a graph showing the measured power factor and displacement power factor as a function of duty cycle.

The results of the power factor verses duty cycle given in FIG. 20 are slightly better than those estimated via the constant resistance simulation for power factor given in FIG. 19. This is due to the error in assuming a constant 13 Ω filament resistance as the actual filament resistance changes quite dramatically as the duty cycle and associated power levels change.

Since power factor is a function of both the displacement power factor and the current distortion factor, PF=dpf * cdf, by dividing the measured power factor by the displacement power factor the current distortion factor can be obtained. This is useful as the current distortion factor gives an understanding of the current harmonic content as the duty cycle changes and also verifies the assumption that for all practical power loads that the current distortion factor is unity (cdf=1.0). Utilizing the data from FIG. 20 and equation 49 the current distortion factor as a function of duty cycle was computed and the results are shown graphically in FIG. 21.

Figure 21:
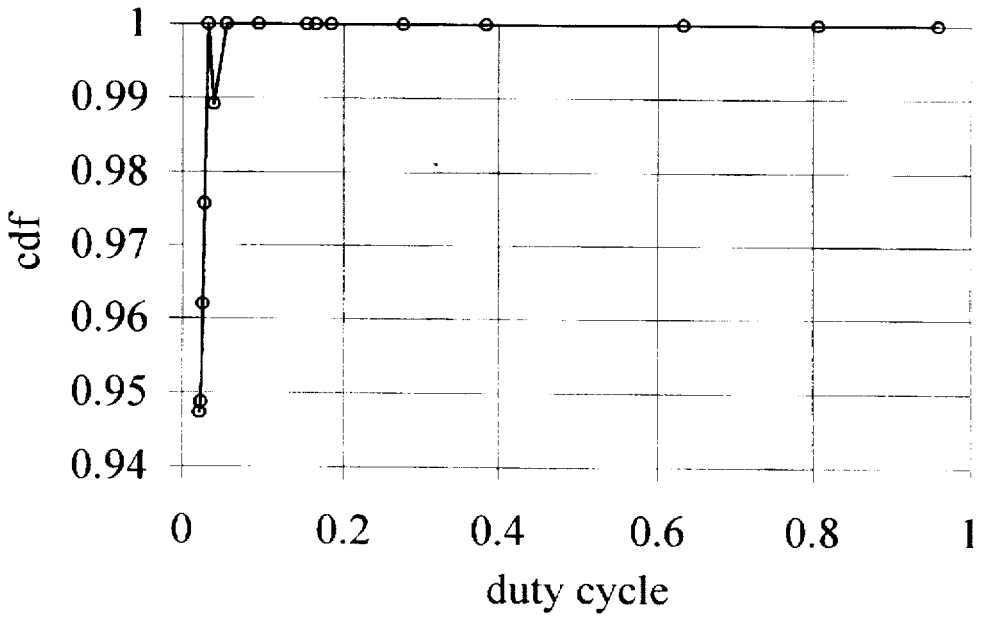
FIG. 21 is a graph showing the measured current distortion factor as a function of duty cycle.

Analyzing the data of FIG. 21 shows that there is essentially no current distortion present until the pulse width modulator is at duty cycles below 0.033. At duty cycles below 0.033 the power converter is no longer consuming enough energy to completely discharge the filter capacitor over every AC half cycle. Also, at low duty cycles, the input inductor is conducting for only a very small portion of the AC cycle and small levels of current harmonic distortion are beginning to occur.

The data of FIG. 21 verify the previous assumption that there is essentially no current distortion present over the range of PWM duty cycles used by the fusing system is valid. FIG. 21 also verifies the assumption that any current distortion at the AC voltage zero crossings is negligible.

It is also of interest to examine the impedance 'seen' by the filament as it is switched into and out of circuit by the power switch. The impedance seen by the filament is that of the input power filter tank. In order to minimize excitation of the power filter tank, it is desirable for the filament to place the switch frequency of the power switch as far above the resonant peak of the filter tank resonant frequency as possible. This may also help in minimizing conducted and radiated emissions as the filament will "see" as low an impedance as possible.

Again the impedance seen by the filament is a parallel LC resonant tank circuit whose impedance is given by $$Z = \frac{s \cdot L \cdot \frac{1}{s \cdot C}}{s \cdot L + \frac{1}{s \cdot C}} \qquad \text{eq. 51}$$

Rearranging equation 51 yields $$Z = \frac{s \cdot \frac{1}{C}}{s^2 + \frac{1}{L \cdot C}} \qquad \text{eq. 52}$$

Figure 22:
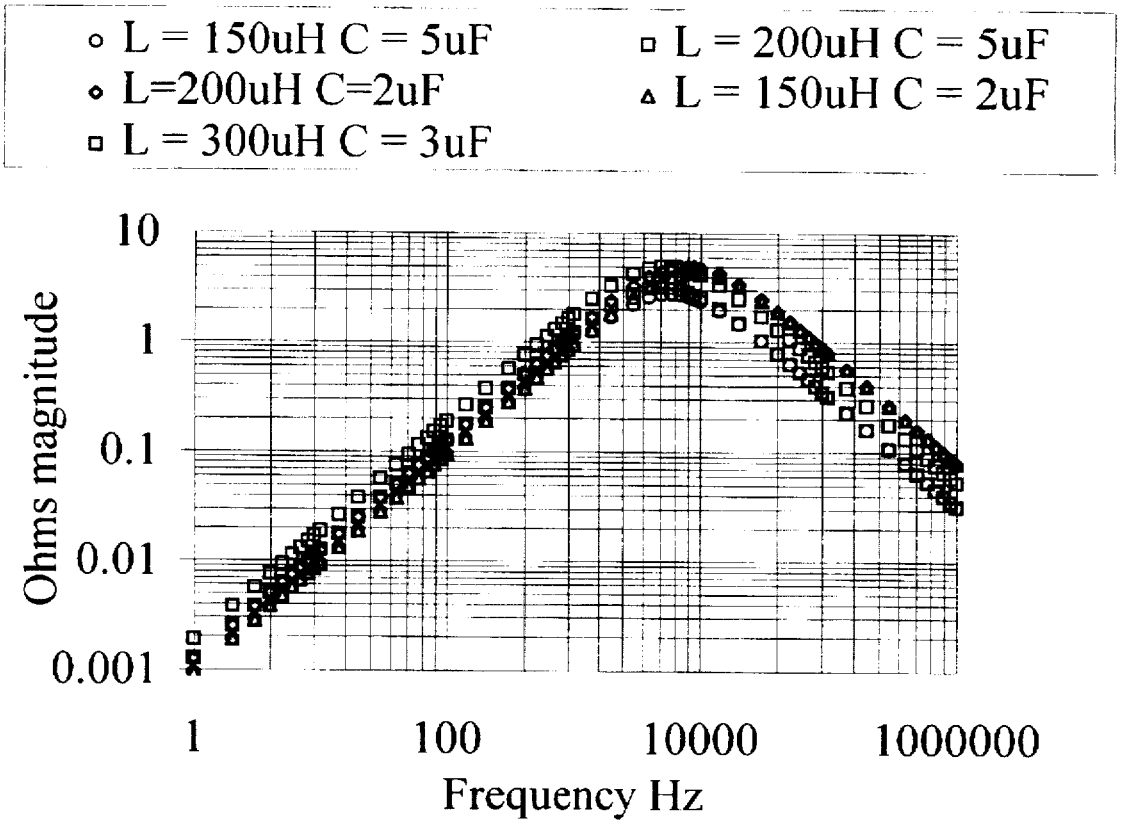
FIG. 22 is a graph showing the impedance seen by the filament as a function of frequency.

A simulation of the power filter impedance utilizing equation 52 as a function of frequency for the filter components of FIG. 16 as well as for other values of filter components was performed and is shown graphically in FIG. 22. The effect of utilizing the suggested filter values of 3 μF and 300 μH as suggested in the power factor analysis above is included in FIG. 22 as well.

Examining the impedance "seen" by the filament at the switching frequency of 20 KHz, it is apparent that for the filter components as specified in FIG. 22 that the filament is seeing an impedance of approximately 1.7Ω and it is almost purely capacitive. The capacitor in parallel with the switched resistive load means that the impedance "seen" by the filament is decreased if the switching frequency is increased. Thus, the magnitude of any current harmonics experienced by the power source would be reduced for any increase in switching frequency or any decrease in the resonant frequency of the power filter components. This topology gives the advantage of a series LC filter to help keep current harmonics low as well as providing significant filtering for the minimization of conducted emissions. Therefore, for the filter component values as specified in FIG. 16 it is desirable to utilize a higher switching frequency than the 20 KHz switching frequency specified. Any increase in switch frequency further decreases the magnitude of the current harmonics at the switch frequency and pushes additional current harmonics (conducted emissions) to higher frequencies where they are more easily filtered with lower cost filter components.

Figure 23:
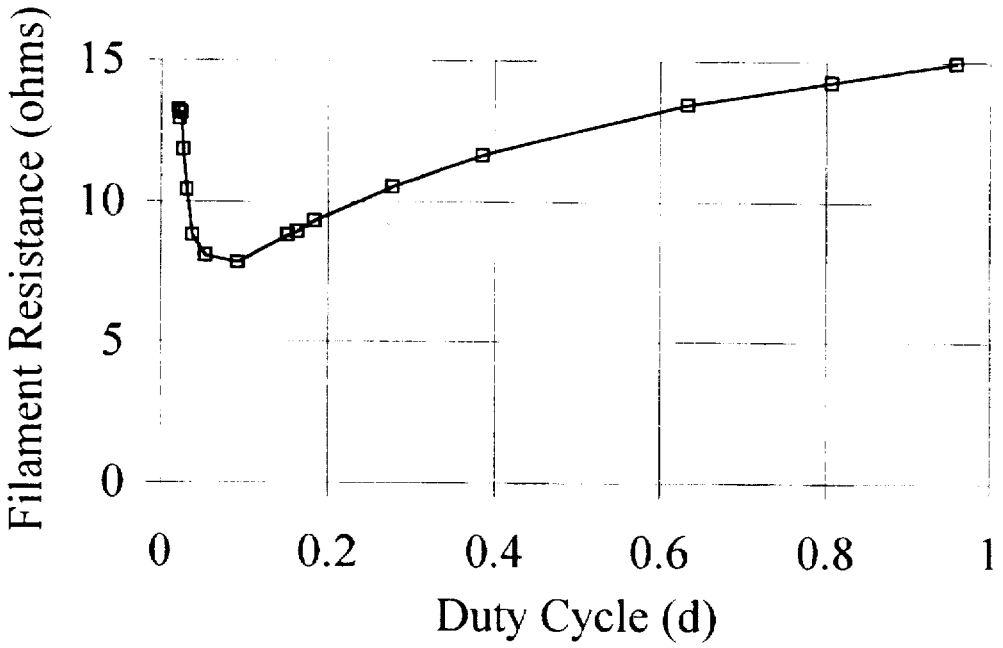
FIG. 23 is a graph showing the computed filament resistance as a function of duty cycle.

In order to verify that the computed filament resistance verses duty cycle of FIG. 23 are accurate a few points of experimental data were gathered for actual power levels and the associated filament resistance by utilizing a programmable high power DC source. DC current levels were programmed and the resulting DC voltage levels were measured and the associated average power and filament resistance were calculated. By utilizing the previously given equation for average power as a function of voltage, filament resistance and duty cycle, equation 30, it is possible to calculate an equivalent duty cycle that the power converter would need in order to yield the same average power for a given rms voltage source from $d=P*R/_V2$. This analysis was performed for the measured power levels and the results are given in Table 1. Table 1 shows the measured power load, measured resistance, computed duty cycle, and the effective resistive AC load, for the new power control system when connected to a 120V AC source.

TABLE 1

| Measured Power | 117.8 W | 255 W | 627 W |
|---|---|---|---|
| Filament Resistance | 8.16 Ω | 10.2 Ω | 12.8 Ω |
| Computed duty cycle | 0.0657 | 0.1776 | 0.5482 |
| Effective Resistance | 124.29 Ω | 57.41 Ω | 23.35 Ω |

Comparing the actual filament resistance and computed duty cycles of Table 1 to the computed filament resistance verses duty cycle of FIG. 23 show a very good relationship for the few experimentally measured filament resistance and the computed filament resistance.

In order to estimate the actual filament resistance at low duty cycles a low power DC experiment was performed. This was accomplished by connecting the filament terminal directly to a DC voltage source and setting the DC voltage source for several different voltages and measuring the resulting filament resistance. Several minutes of operation at each voltage level were required in order to allow the filament resistance and power levels to stabilize. From this experiment the data of table 2 was collected.

TABLE 2

| DC Voltage | Measured Resistance | Average Power |
|---|---|---|
| 1.00 V | 1.59 Ω | 0.630 W |
| 2.00 V | 1.76 Ω | 2.270 W |
| 3.00 V | 2.04 Ω | 4.410 W |
| 4.00 V | 2.29 Ω | 6.990 W |
| 7.09 V | 3.21 Ω | 15.66 W |
| 7.46 V | 3.33 Ω | 16.71 W |

By utilizing the low power filament resistance data of table 2 and the computed filament resistance of FIG. 23 the filament resistance for low duty cycles was estimated through standard graphical methods. The resulting filament resistance verses duty cycle data is shown graphically in FIG. 24.

Figure 24:
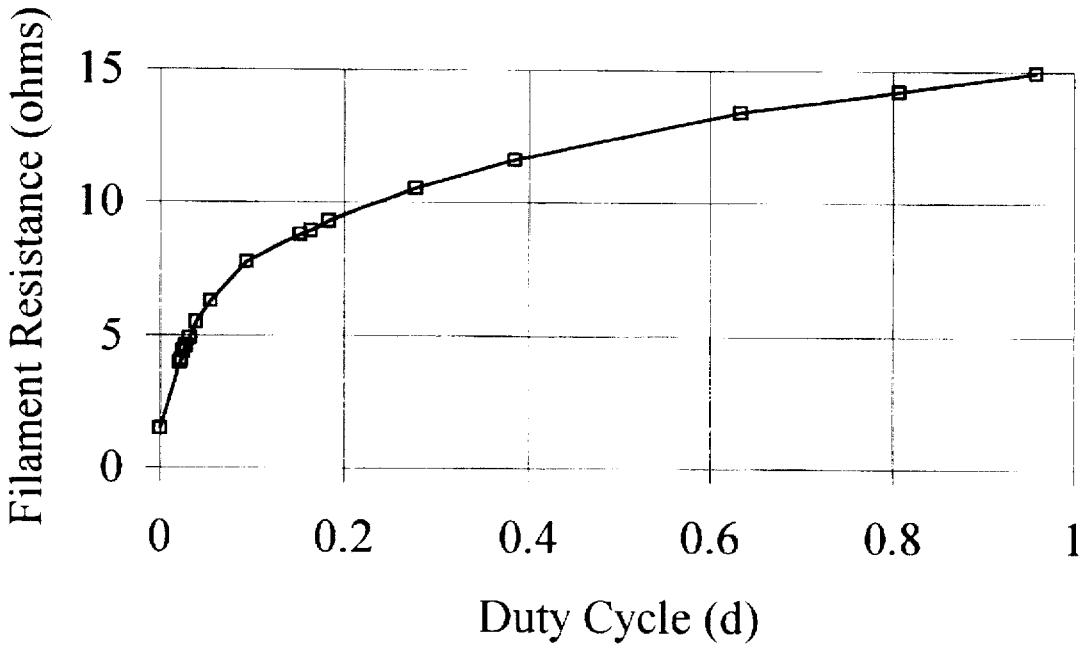
FIG. 24 is a graph showing the corrected filament resistance as a function of duty cycle.

The filament resistance verses duty cycle of FIG. 24 is only valid for AC source voltage near 120 Vrms. For instances in which the same 950 W 115 V rated fuser heating lamp is used in higher AC voltage systems, 220 V for instance, the duty cycle scale can be renormalized by assuming a constant resistance and equating average powers at each voltage level and then computing a duty cycle scaling.

As an example suppose that the printer possessing this new power control topology and possessing the same fusing system heating lamp is powered by a 50 Hz 220 Vrms AC source in Europe rather than a 60 Hz 121 Vrms AC source in the United States. To find the duty cycle that yields a similar filament power level in Europe as in the US, proceed as follows:

Equating powers at each voltage level yields:

$$P_{avg1}=P_{avg2} \qquad \text{eq. 53}$$

Substituting in the previously derived duty cycle dependent power equation at the source voltages assuming a constant resistance yields:

$$\frac{(V_{1rms})^2}{R}\cdot d_1=\frac{(V_{2rms})^2}{R}\cdot d_2 \qquad \text{eq. 54}$$

By dividing both sides by the square of the second source voltage and multiplying both sides by the resistance yields:

$$d_2=\frac{(V_{1rms})^2}{(V_{2rms})^2}\cdot d_1 \qquad \text{eq. 55}$$

The ratio of the square of the voltage terms is the same as the square of the ratio of the voltage terms and thus the equivalent duty cycle at the new source voltage is $$d_2=\left(\frac{V_{1rms}}{V_{2rms}}\right)^2\cdot d_1 \qquad \text{eq. 56}$$

The duty cycle and corresponding filament resistance for operating at the new voltage level and duty cycle can be found by substituting in the values for the new voltage, the 121V voltage used to derive FIG. 24 and the duty cycle of the filament resistance of FIG. 24 that is to be translated.

As an example suppose it is desired to estimate the duty cycle required to yield a filament resistance of 14 Ω for the 950 W heating element when connected to a 220 Vrms AC source. Utilizing equation 56 and the initial source voltage of 121 Vrms and a duty cycle of 0.81 which yielded a 14 Ω filament resistance yields a new duty cycle of 0.245 for the 220 Vrms system.

Now that the non-linear filament resistance as a function of duty cycle is known for a 121 Vrms 60 Hz system the resulting power losses in the switch are easily found. If the power converter were driving a constant resistance load rather than a non-linear power dependent filament resistive load then the converter would experience constant switching losses and linearly decreasing conduction losses as duty cycle decreases from 1 to 0.

The typical power switch suffers from two power loss mechanisms. The first being the "conduction loss" which is due to the 'on-state' voltage of the switch multiplied by the current flowing through the switch and the second due to frequency dependent "switching losses". The conduction losses due to the on resistance of the power MOSFET (or IGBT) switch as well as the switching losses must be examined in some detail to ensure that these losses are acceptable.

In the case of the power control topology considered here, when the switch is on the on-voltage of the switch as well as the current in the switch vary periodically with the AC source. In a power MOSFET switch the on-voltage is a function of the current, $I_o$, flowing through the switch multiplied by the "on-resistance", $Rds_{on}$, of the MOSFET switch.

The on-resistance of the switch and the filament resistance form a simple two-series-resistor circuit which allows the voltage across the switch resistance as well as the total current flowing through the circuit to be easily found through direct application of Ohm's law.

The current flowing through the switch is $$I_{rms}=\frac{Vrms}{R+R_{dson}} \qquad \text{eq. 57}$$

and the voltage across the switch is $$V_{onrms}=I_{rms}\cdot R_{dson}=\frac{V_{rms}\cdot R_{dson}}{R+R_{dson}} \qquad \text{eq. 58}$$

Since the current flowing through the switch is varying periodically with the AC voltage source it is more convenient to represent the average power-on loss of the switch as $$P_{on}=\frac{V_{rms}}{R+R_{dson}}\cdot V_{rms}\cdot\frac{R_{dson}}{R+R_{dson}}\cdot d \qquad \text{eq. 59}$$

where d is the duty cycle, V is the RMS value of the AC voltage source, R is the value of the filament resistance, and $Rds_{on}$ is the "on-resistance" of the power switch. If this power controller where driving a constant resistance load the power-on losses in the switch would decrease linearly with duty cycle. However, the filament resistance for the fusing system considered here is a non-linear function of the duty cycle and will cause the power-on switch losses to be higher at low duty cycles than would be expected for the constant resistance case.

The on-resistance of the MOSFET of FIG. 16 is given by the manufacturer as 0.15 Ω. By specifying a supply voltage of 121 Vrms and utilizing the filament resistance verses duty cycle information from FIG. 24, which is for a 121 Vrms source, and the on-resistance of the MOSFET switch equation 59 allows the conduction loss in the power switch of the new power control topology to be calculated. The switch conduction losses for the new power control topology with the non-linear filament resistance verses duty cycle were calculated and are shown graphically in FIG. 25. Calculations for conduction losses verses duty cycle for the case of a fusing system using a constant resistance load such as utilized in U.S. Pat. No. 5,196,895 where also performed so that a comparison against those of the non-linear filament resistance dependent switch losses could be made. The results of the calculations for conduction loss for a constant resistance load appear along with the non-linear conduction loss calculations in FIG. 25 for comparison.

Figure 25:
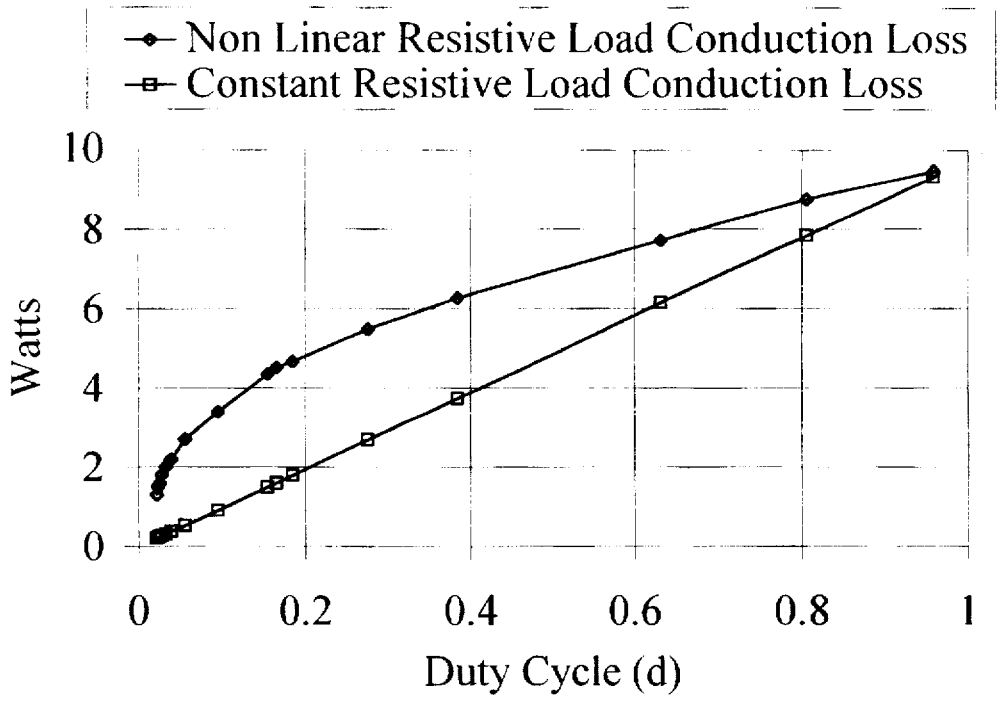
FIG. 25 is a graph showing the switch conduction loss as a function of duty cycle.

The data of FIG. 25 show that the conduction losses for the nonlinear filament resistance are higher than for the case of a constant resistance load for low duty cycles. Thus the power switch will be operating at slightly elevated temperatures as compared to the typical proportionally controlled triac power control system.

It was observed that if the PWM duty cycle was quickly ramped from 0 to 0.95, held for a period of time, and then quickly ramped down to 0 with the fuser temperature control system as an oscillating proportional controller that there was a barely noticeable temperature increase in the switch temperature. This case is similar to the presently proportionally controlled triac. Conversely, if the PWM duty cycle was fixed at a low duty cycle to maintain fuser temperature, the switch temperature was much higher and therefore the conduction loss and switching loss of the switch are higher than the triac losses.

Figure 26:
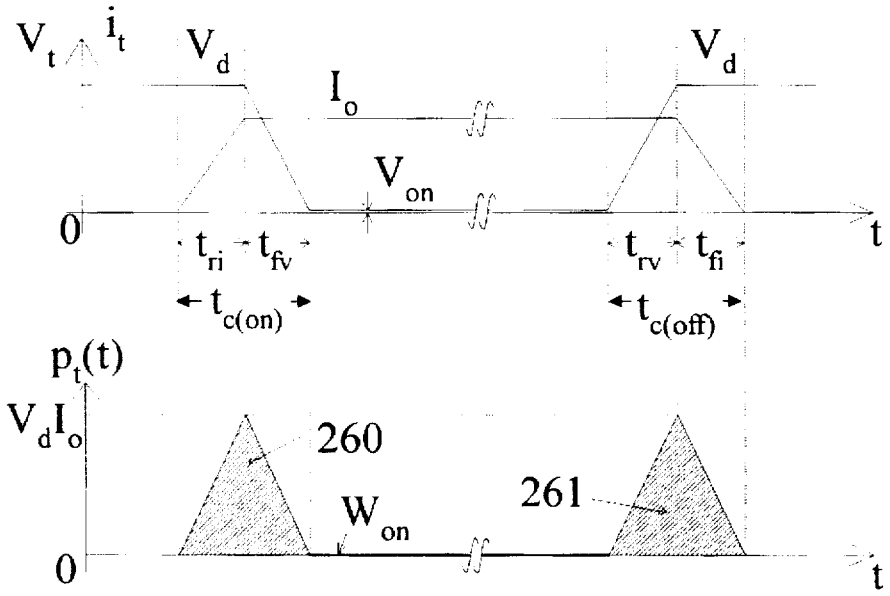
FIG. 26 graphically shows a model for switch waveforms and instantaneous switch power loss.

To begin the analysis of switching losses assume that the power switch of FIG. 16 has been off for awhile. During the turn-on transition 260 the current in the self inductance of the filament will rise nearly linearly from 0 to its final value, $I_o$, during the current rise time $t_{ri}$. After the final value of the current flows through the switch, the switch voltage will start to fall with a voltage fall time of $t_{fv}$. Large values of switch voltage and current will be present simultaneously during the turn-on crossover interval, $t_{c(on)}$, which is the sum of the current rise time and the voltage fall time, and are shown graphically in FIG. 26.

The energy dissipated in the switch during the turn on transition 260 can be approximated as:

$$W_{c(on)} = \frac{1}{2} \cdot V_d \cdot I_o \cdot t_{c(on)} \qquad \text{eq. 60}$$

When the switch is starting the transition from the on-state to the off-state the voltage across the switch rises from the on-voltage, $V_o$, to the source voltage during the voltage rise time, $t_{rv}$. After the voltage on the switch reaches its final value the fly-back diode of FIG. 16 starts to conduct and the current in the switch falls to zero during the current fall time, $t_{fi}$. Again large values of switch voltage and current will be present simultaneously during the turn-off crossover interval, $t_c$(off) which is the sum of the voltage rise time and the current fall time, and are also shown graphically in FIG. 26.

The energy dissipated in the switch during the turn off transition 261 can be approximated as:

$$W_{c(off)} = \frac{1}{2} \cdot V_d \cdot I_o \cdot t_{c(off)} \qquad \text{eq. 61}$$

Undelund, T., Mohan, N. & Robbins, W., "Power electronics: converters, applications, and design", ISBN 0-471-61342-8 (1989) incorporated herein by reference (herein referred to as Undelund) shows that the average switching power loss, $P_s$, due to switching transitions can be approximated by $$P_s = \frac{1}{2} \cdot V_d \cdot I_o \cdot f_s \cdot (t_{c(on)} + t_{c(off)}) \qquad \text{eq. 62}$$

where $V_d$ is the source voltage, $I_o$ is the current flowing in the inductive element, $f_s$ is the switching frequency, $t_{c(on)}$ is the turn-on crossover interval and $t_{c(off)}$ is the turn-off crossover interval.

In order to estimate the non-linear filament resistance dependent switching losses in the new power converter topology, the filament resistance and its effects on switch current must be accounted for. By replacing the current, $I_o$, of equation 62 with the equivalent current drawn from the voltage source by the series combination of the non-linear duty cycle dependent filament resistance and the switch resistance of equation 57 will allow the switch losses of the power switch to be estimated as a function of duty cycle.

Performing these substitutions yields an estimated switch loss equation of $$P_s = \frac{1}{2} \cdot V_{rms} \cdot \frac{V_{rms}}{(R_{dutycycle} + R_{dson})} \cdot f_s \cdot (t_{c(on)} + t_{c(off)}) \qquad \text{eq. 63}$$

which can be used to estimate switch losses as a function of duty cycle where $R_{dutycycle}$ is the filament resistance at the particular duty cycle of interest as shown in FIG. 24 and $R_{dson}$ is considered constant.

The particular switch specified above (MTY30N50E) has a typical on resistance, $R_{dson}$, specified by the manufacturer as 0.15 Ω. The current rise and fall times are specified as each typically being 100 nS but no information is available for the voltage rise and fall times. In order to estimate the total turn-on/off crossover intervals the voltage rise and fall times were estimated to total 100 nS.

Data for filament resistance verses duty cycle from FIG. 24 for a 121 Vrms source was used along with equation 63 to compute the estimated switch losses as a function of duty cycle. The estimated switch losses as a function of duty cycle as well as the non-linear resistance conduction losses of FIG. 25 and the total of these two estimated switch losses appear in FIG. 27.

Figure 27:
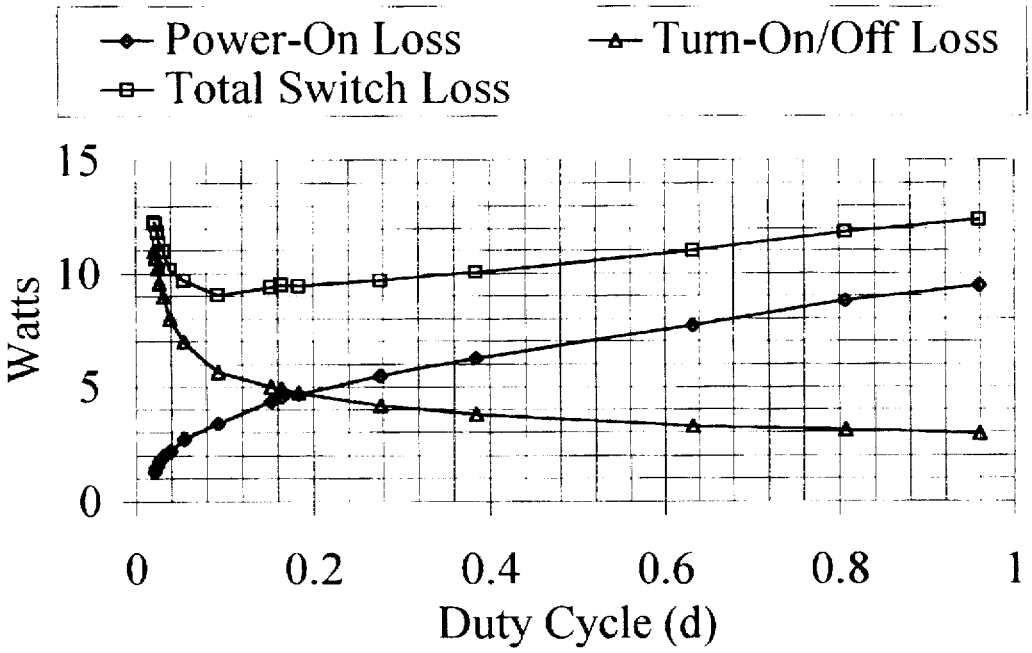
FIG. 27 is a graph showing the estimated switch losses as a function of duty cycle.

FIG. 27 shows how the switching losses of the power switch are influenced by the non-linear filament resistance at low duty cycles. The total switch loss for the converter is strongly dominated by the non-linear effects of the filament resistance at low duty cycles which results in higher average power being dissipated by the switch at low duty cycles than at large duty cycles.

The overall efficiency of a power control system is given by:

$$\%\ \text{efficiency} = \frac{P_{total} - P_{loss}}{P_{total}} \cdot 100 \qquad \text{eq. 64}$$

where $P_{total}$ is the total power consumption and $P_{loss}$ is the power losses in the switch.

The conduction losses and switching losses of the power switch dominate the losses in the system, therefore the losses in the fly-back diode will be ignored. Due to the care taken in the selection and specification of the filter components the losses in the input inductor and the filter capacitor are also insignificant and can be ignored. By utilizing the data of FIG. 21 for measured total power consumption as a function of duty cycle and the data of FIG. 27 for simulated total switch loss as a function of duty cycle and equation 64 the efficiency of the power controller as a function of duty cycle was computed and is presented graphically in FIG. 28.

Figure 28:
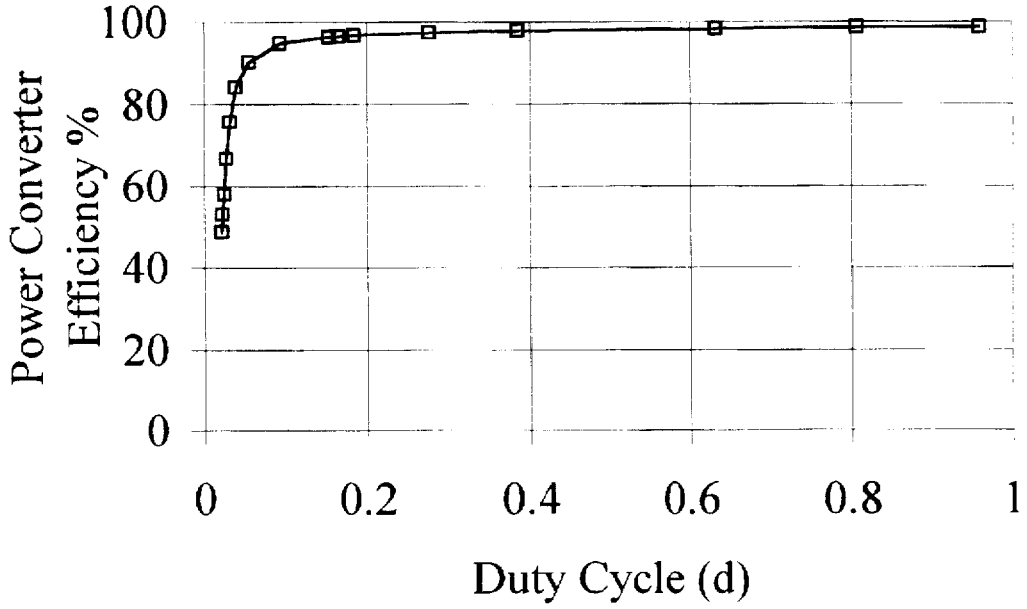
FIG. 28 is a graph showing the converter efficiency as a function of duty cycle for a 121 Vrms source.

The graph of FIG. 28 shows the overall efficiency of the power converter topology and also shows how the non-linear resistance of the filament at low power levels degrades the efficiency of the converter.

Figure 29:
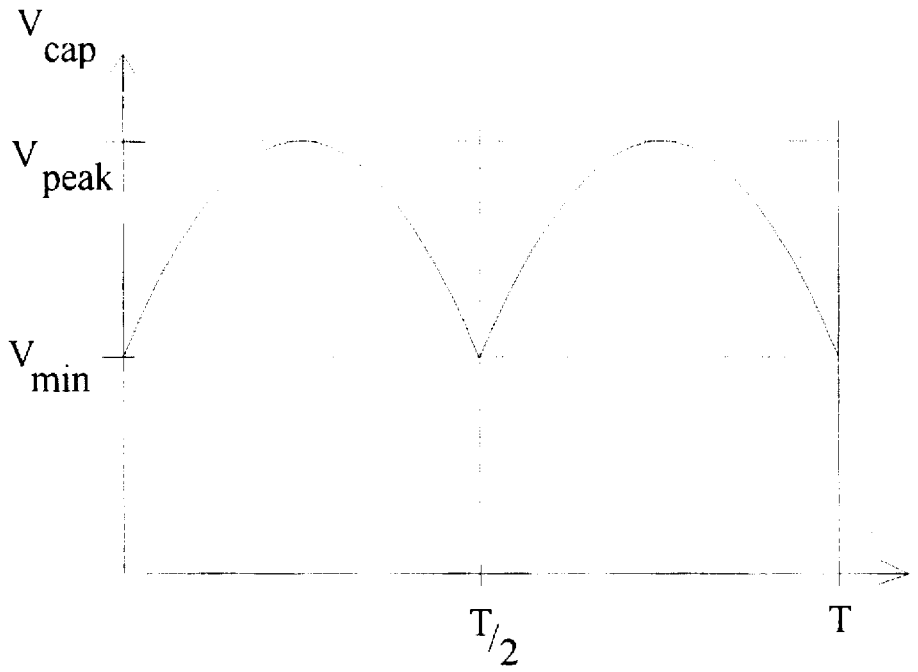
FIG. 29 shows power filter minimum voltage at given duty cycle.

It was observed that for all duty cycles above 0.1 that the filter capacitor voltage waveform appeared as a nondistorted fully rectified AC waveform that sinusoidally increased from 0 volts to ✓2*121 volts and then sinusoidally decreased to 0 and repeated. At duty cycles below 0.1 the capacitor voltage waveform still appeared as a nondistorted fully rectified AC waveform but the waveform was now DC biased by a few volts, the maximum voltage on the filter capacitor was still ✓2*121 volts. As the duty cycle continued to decrease the DC bias continued to increase while the maximum voltage on the filter capacitor stayed at ✓2*121 volts. This is a well known phenomena that rectifier filter designs must consider. FIG. 29 shows the classic full wave rectified half-sines which appear on the highly loaded filter capacitor with the peak voltage of the AC source and the minimum voltage on the capacitor at the zero crossings of the AC sinusoid.

Figure 30:
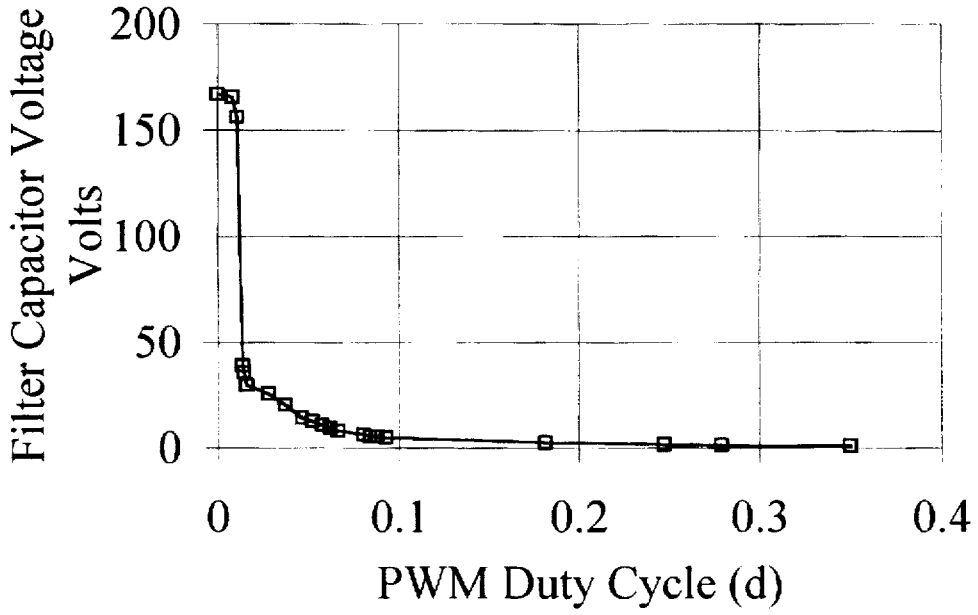
FIG. 30 is a graph showing the power filter minimum voltage as a function of duty cycle.

At very low duty cycles, d<0.015, the filter capacitor voltage waveform appeared to be a nearly constant ✓2*120 volt DC with a decreasing amount of ripple as the duty cycle approached 0. The data for the minimum filter capacitor voltage as a function of duty cycle is shown in FIG. 30.

The fuser heating lamp filament and its associated power wiring exhibit a rather large amount of parasitic inductance of approximately 2.8 μH, which tends to increase the turn-off losses of the power switch. Therefore a turn off snubber on the switch may be necessary. However, the MOSFET switching transistor as specified in FIG. 16 is rated for power dissipation in excess of 300 Watts when properly heat sinked. If it is desired to utilize a less expensive power switch then an external snubber may cost less to implement than the cost difference between a family of switches and in turn would become an area of cost reduction in the overall power converter design. The snubber would then dissipate the additional energy due to the filament inductance during turn off of the switch. Undelund, as well as others, present methods for inductive load turn-off snubber design for reducing the energy dissipated by the switch during turn-off.

Figure 31:
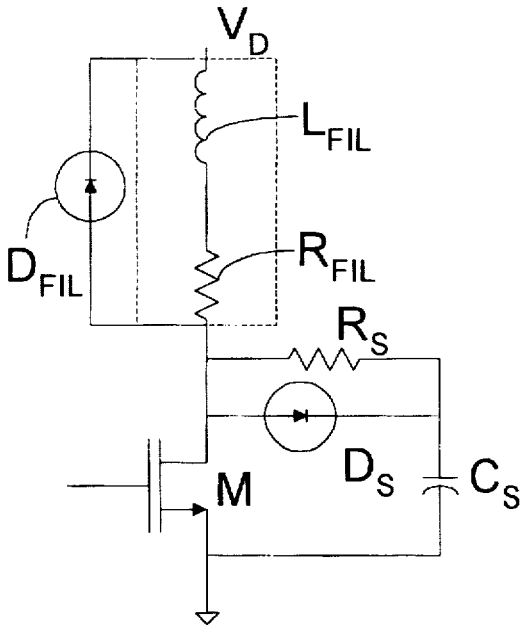
FIG. 31 shows an inductive switching turn-off snubber

The turn-off snubber design presented by Undelund assumes a freewheeling diode anti-parallel to the inductive load which will carry the current in the inductive load once the switch in the power converter is fully off. During the initial design of the power converter of FIG. 16 it was assumed that freewheeling diode Df would be necessary in order to carry the filament current once the power switch turned off. The schematic in FIG. 31 shows the Undelund turn-off snubber configuration combined with the power converter prototype power switch.

Undelund presents design methods for selection of the values of snubber capacitor, $C_s$, and snubber resistor, $R_s$. The equations presented by Undelund are for a DC voltage source and a constant DC current flowing in the inductive load. The fact that the source voltage and load current are sinusoidal rather than DC does not alter their use for the power converter considered here as the average power dissipated by the power switch and relieved from the switch by the snubber are unchanged.

If the turn-off snubber were altered to capture all of the energy stored in the magnetic field of parasitic inductance $L_{fil}$ then the expensive freewheeling diode $D_f$ could be removed. This is easily accomplished with slight alterations in component values of the turn-off snubber.

For the power converter topology of the preferred embodiment, the current flowing in inductive load $L_{fil}$ after the filament time constant has been exceeded by three time constants is simply $$I_o = \frac{Vd}{R_{fil}} \qquad \text{eq. 65}$$

where $R_{fil}$ is the resistance of the filament. The energy stored in the magnetic field of parasitic $L_{fil}$ inductance of the filament and power wiring is given by $$W = \frac{L \cdot (I_o)^2}{2} \qquad \text{eq. 66}$$

The energy stored in the electric field of snubber capacitor $C_s$ is given by $$W = \frac{C_s \cdot Vd^2}{2} \qquad \text{eq. 67}$$

Setting equation 66 equal to equation 67 and substituting in equation 65 for the current flowing through the filament yields a snubber capacitor $C_s$ selection of $$C_s = \frac{L}{(R_{fil})^2} \qquad \text{eq. 68}$$

Substituting in the parasitic inductance of 2.8μH and assuming a filament resistance of 8Ω yields a snubber capacitance of 0.044μF.

Now that snubber capacitance $C_s$ is known snubber resistance $R_s$ can be easily specified by selecting a resistance which will discharge snubber capacitance $C_s$ within the smallest expected on-time of the switch. The resistor should also be large enough to limit the surge current through snubber resistor $R_s$ when switch M is re-energized. If snubber resistor $R_s$ is chosen as 20 Ω then the snubber RC time constant will be 0.88 μS. Snubber capacitor $C_s$ is essentially completely discharged after three time constants or 2.7 μS. This is much less than the expected minimum on time of the switch and is thus satisfactory.

The power dissipated in snubber resistor $R_s$ is also an important consideration which may cause the designer to modify the selection of the snubber capacitor. The power dissipated by snubber resistor $R_s$ is the total energy stored in snubber capacitor $C_s$ multiplied by the switch frequency as $$P = \frac{C_s \cdot Vd^2 \cdot f_s}{2} \qquad \text{eq. 69}$$

If the supply voltage is 120 Vrms, the switching frequency is 20 KHz, and the snubber capacitor is 0.044 μF then the average power dissipated by snubber resistor $R_s$ is found from equation 69 to be 6.34 W. This is also the reduction in the switching losses of the power switch. If the same design were to be powered by a 240 Vrms source then the power dissipated by the snubber resistor would be 25.34 W. This is a dramatic increase and high power resistors are physically large and also expensive. If snubber capacitance $C_s$ were to be reduced to 0.022 μF then the average power dissipated by snubber resistor $R_s$ would decrease to 3.17 W at 120 Vrms and 12.67 W at 240 Vrms.

These lower power levels will allow a less expensive snubber resistor to be utilized. This change will also cause the snubber capacitance to resonate with the load inductance. The excess energy in the magnetic field of the load inductance will cause the snubber capacitor voltage to overshoot the source voltage. After the current has stopped flowing through the inductor into the snubber capacitance the current flow will reverse until the voltage on the snubber capacitor equals the supply voltage.

This approach of optimizing the turn-off snubber to snub the energy stored in the parasitic inductance of the tungsten filament heating element and associated power wiring is much cheaper than the use of a high speed, high voltage, high current anti-parallel fly-back diode. This approach also helps to minimize radiated emissions as well as minimizes the sources available for the generation of conducted emissions as it reduces both the dv/dt and the di/dt of the circuit.

The frequency of this oscillation can be estimated directly from load inductance $L_{fil}$ and snubber capacitance $C_s$ as $$f=\frac{1}{2\cdot\pi\cdot\sqrt{L\cdot C_s}} \qquad \text{eq. 70}$$

Figure 32:
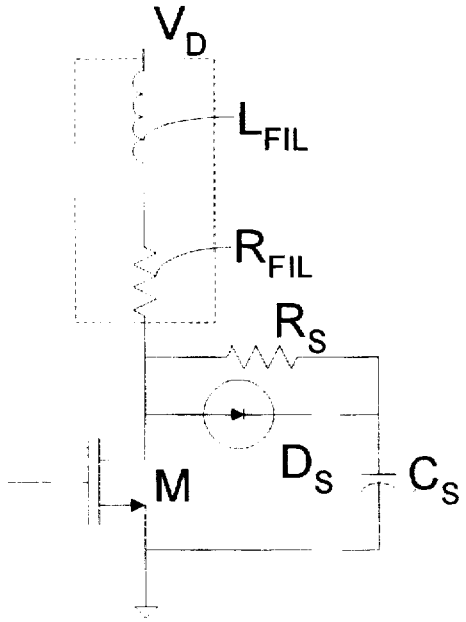
FIG. 32 show a simplified schematic of a turn-off snubber as used in the preferred embodiment in accordance with the present invention.

Substituting in the new values for load inductance $L_{fil}$ and snubber capacitance $C_s$ yields a resonant frequency of approximately 641 KHz which should not be of much concern from the stand point of radiated or conducted emissions due to the long 467 meter wavelength of this oscillation. The modified turn-off snubber with freewheeling diode $D_{fil}$ removed from the filament is shown in FIG. 32.

Due to the large peak current handling capability of the MOSFET it was determined that a turn-on snubber was not necessary for the switch specified in FIG. 16 for 120 VAC prototype development purposes. If the same power MOSFET were to be utilized on a 220 VAC system then a turn-on snubber would be necessary to limit the peak currents flowing in the switch. Alternately an IGBT switch could be utilized which, with its inherently higher surge current ratings, would reduce or eliminate the need for a turn-on snubber.

Due to the voltage ratings of the switch specified in FIG. 16 and the large value of turn-off snubber capacitance it was determined that an over voltage snubber was not necessary for the switch specified in FIG. 16 for 120 VAC prototype development purposes. The 500 V maximum drain to source voltage rating also allows the 220 V system to forego the over voltage snubber as well.

Next, an exemplary control system for controlling the temperature of the fusing system is presented. This control system utilizes the knowledge of the heating characteristics of the fuser filament along with the knowledge that the human eye is most sensitive to temporal changes near the 8 Hz to 10 Hz rate as well as the concept of shape factors to control the rate at which power is applied to the filament to bring the fusing system up to operating temperature. From the study of the electrical characteristics of the filament it is known that the filament resistance exhibits a thermal time constant of 330 mS while heating. Also, from the summary of flicker regulations it is known that the best reduction in flicker is for the case in which a ramp voltage change is implemented with a ramp time of at least 1 second.

The control system is driven by the requirement of a slowly changing current to minimize flicker and the need to design a temperature control system that maintains fuser temperature comparable to or better than the existing triac based system. The balancing of flicker levels against adequate fuser temperature control is the important tradeoff in the design of the fuser temperature control system.

Figure 33:
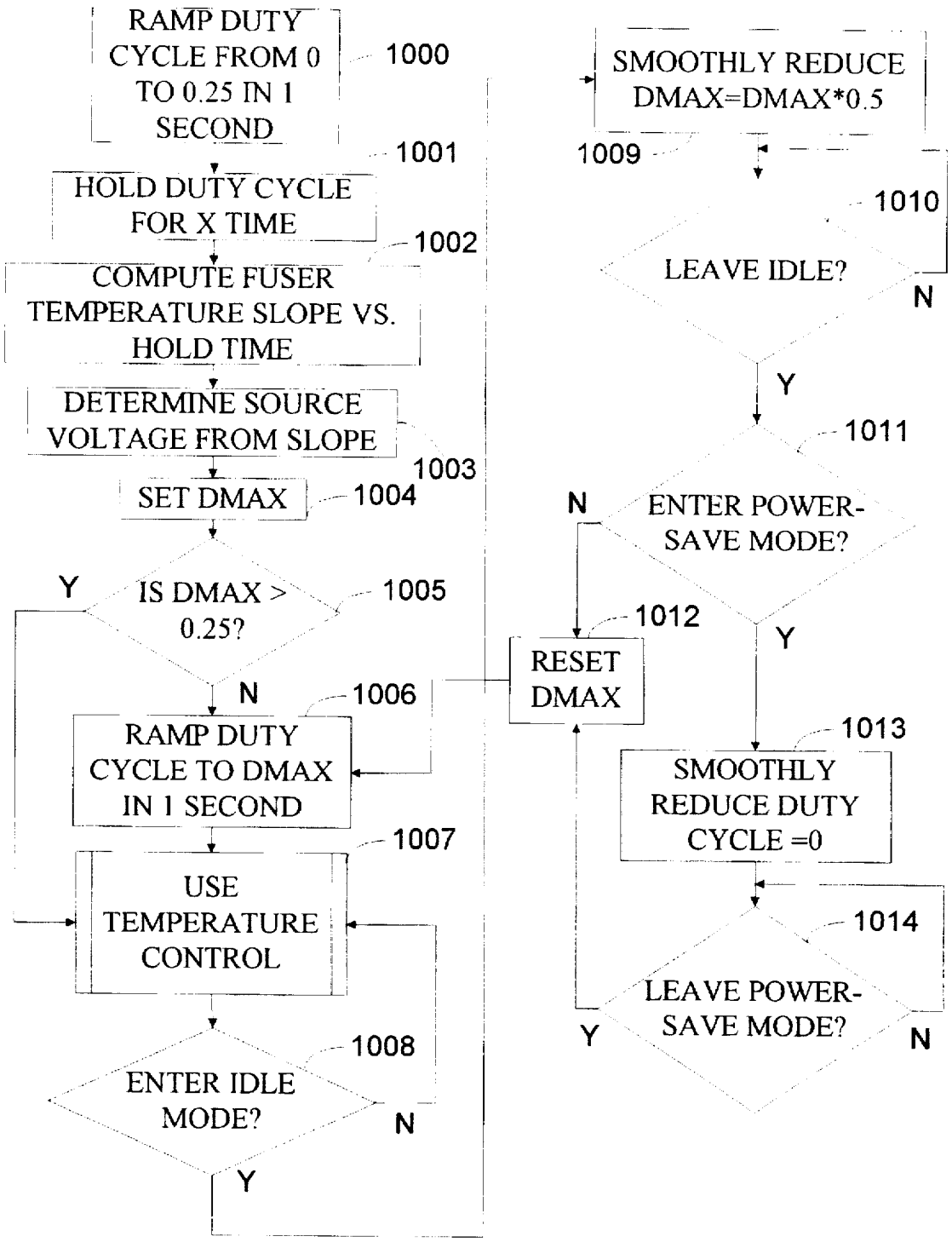
FIG. 33 is a flow chart showing the overall control process.

The control system may reside within software or firmware executed by a digital computer. Referring now to FIG. 33, where a flow chart showing one embodiment of the overall control system is presented. First, the control system must determine the input voltage. The duty cycle is ramped from 0 to 0.25 over a 1 second period 1000. The ramp interval may be shorter of longer, however a time of at least 1 second will provide the maximum flicker reduction. Also, the final value of 0.25 correlates to the maximum value of the duty cycle for the highest specified input voltage of 220 Vrms. Other fuser systems may have a different value associated with the maximum voltage.

The duty cycle is held at 0.25 for a time as the fuser temperature increases 1001. The exact amount of time must be determined for each application because it depends on the thermal mass and transport lag of the fuser system. A time of 20 seconds was used for the fuser system of the printer under test. The temperature slope is determined from the time interval and the fuser temperature 1002. From the slope, the source voltage can be determined 1003.

To insure safe operation of the fuser, a maximum duty cycle ($D_{MAX}$) is assigned based on the source voltage 1004. In the preferred embodiment $D_{MAX}$ was empirically determined such that if the source voltage is ≦110 Vrms, then $D_{MAX}$=1.0; if source voltage=127 Vrms, then $D_{MAX}$=0.75; and if the source voltage=220 Vrms, then $D_{MAX}$=0.25. If the duty cycle is not already at $D_{MAX}$ 1005, then it is ramped up to $D_{MAX}$ over a 1 second period 1006. After the duty cycle has reached $D_{MAX}$, the temperature control process for maintaining the proper temperature is invoked. This process is described in more detail below.

Once printing is complete, the fuser enters the idle mode 1008, by ramping down $D_{MAX}$ by 50%. The printer may exit the idle mode 1010 to enter either the printing mode or the power save mode. If the printer enters power save mode, 1011, the power to the fuser if turned off by ramping the duty cycle down to zero 1013. To exit either power save or idle mode, $D_{MAX}$ must be reset 1012 to its original value as determined in 1004.

Figure 34:
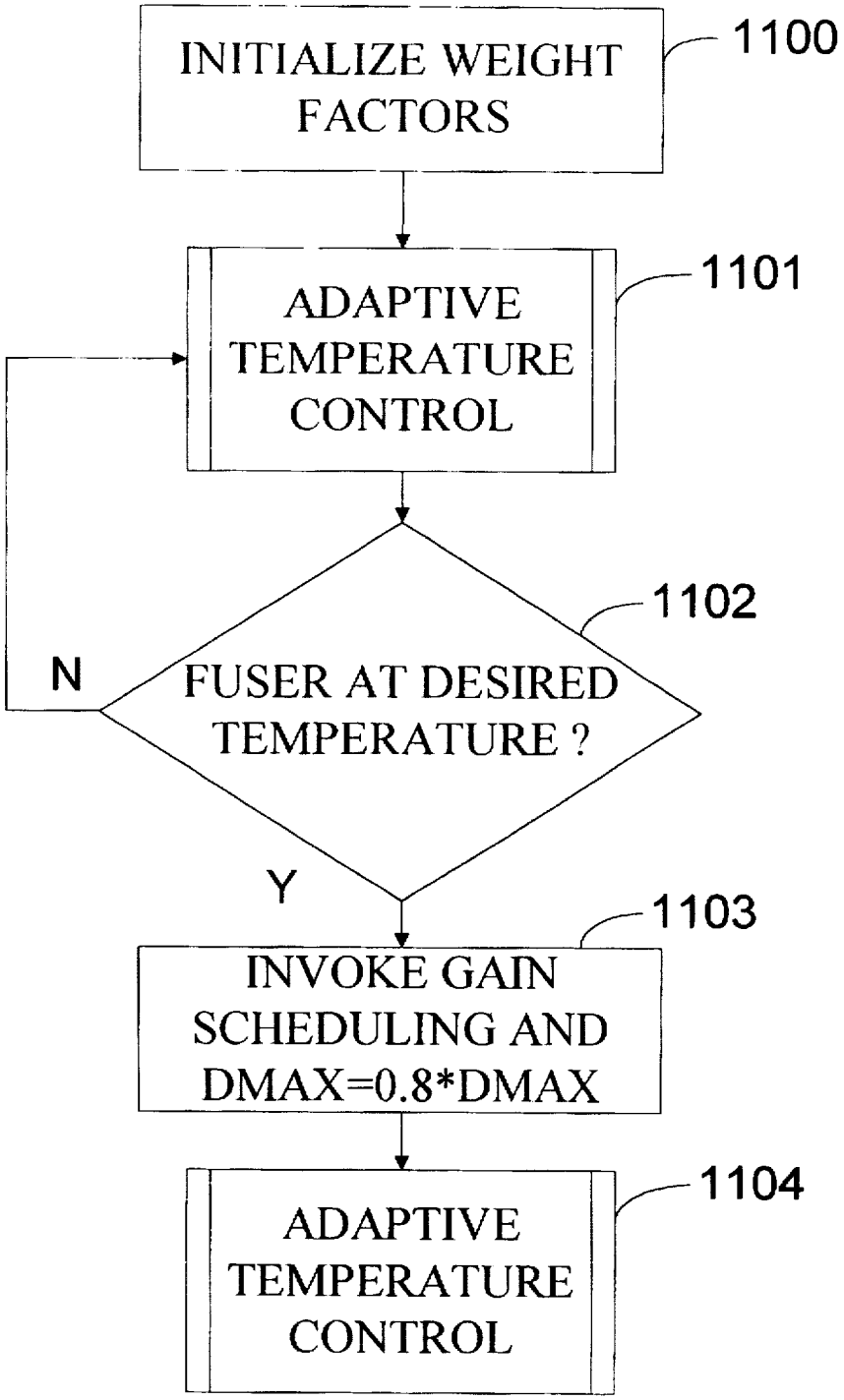
FIG. 34 is a flow chart showing the adaptive temperature control process.

The temperature control system 1007 is shown in more detail in FIG. 34. It may be designed with either traditional control techniques and translated into the discrete time domain or it can be designed completely in the discrete time domain. The control system is implemented in a conventional feedback control structure such as a classic proportional-integral, PI, controller. Adaptive control is an additional avenue open to the temperature control system and is a structure that also fits a conventional feedback control system.

Figure 35:
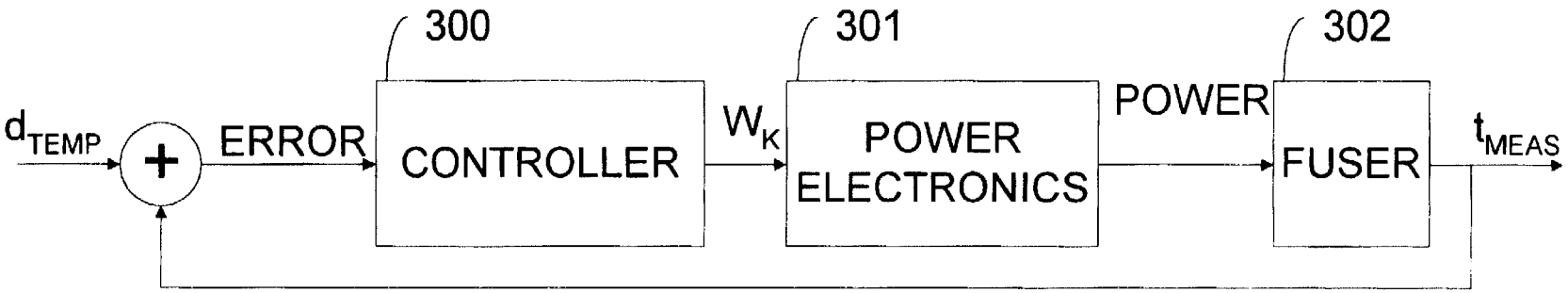
FIG. 35 is a block diagram of a conventional feedback fuser temperature control system.

The conventional foundation for feedback control is presented in block form in FIG. 35 where the input to the system is the desired fuser temperature, $d_{temp}$, and the feedback quantity is the measured fuser temperature, $t_{meas}$. The temperature error signal is supplied as in input to the controller 300 whose output, $W_k$, directly controls the duty cycle of the pulse width modulator in the power electronics block 301.

The controller 300 of FIG. 35 may be of the proportional, PI, PID or adaptive type and could contain detailed models of the dynamics of the fusing system. The power electronics 301 can be considered a linear power amplifier which possess fast dynamics. Fuser 302 on the other hand will possess considerably slower dynamics and it may prove necessary to include these dynamics in the design of temperature controller for either performance or stability reasons.

The preferred embodiment of the present invention uses an adaptive control system based on adaptive linear combiner using an LMS (Least Mean Square) type of algorithm such as taught by Widrow, B. & Sterns, S., "Adaptive Signal Processing", ISBN 0-13-004029-01 (1985) (herein incorporated by reference). Adaptive control systems are very attractive in that they can be implemented with very little knowledge of the system to be controlled as they will adapt themselves to the problem. Adaptive control systems can be easily modified for fast or slow adaptation and can thus, adapt quickly to bring a system under control and then switch to slow adaptation for fine control around a desired set point.

The preferred embodiment uses a one weight adaptive structure and an LMS type algorithm. A simple one weight approach has many advantages with the greatest being the ability to replace the existing control system without undue processor overhead. This allows for the highest probability of implementation in a mass produced printer or copier.

Figure 36:
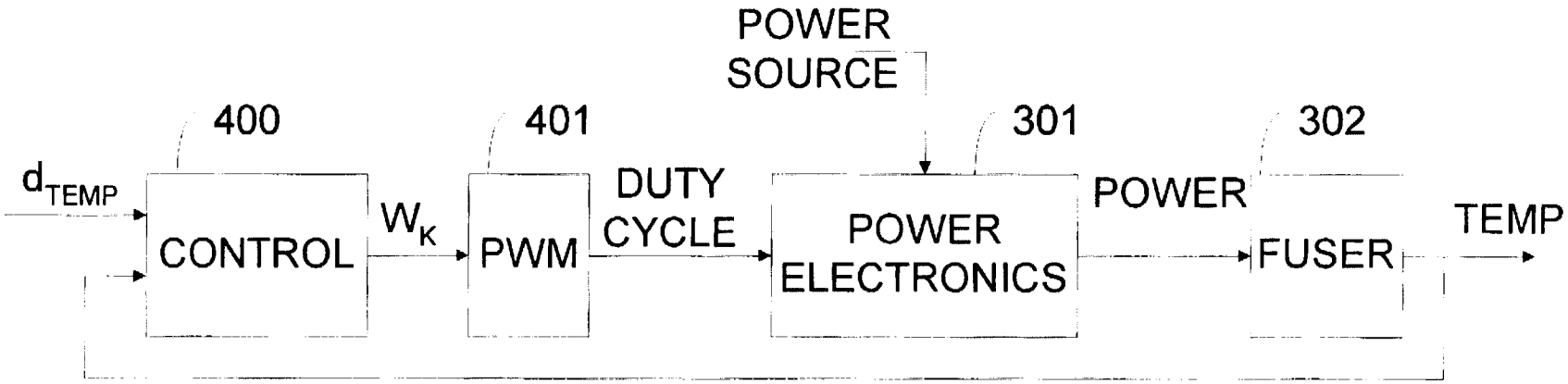
FIG. 36 is a block diagram of overall fusing temperature control system as used in the present invention.

A view of the arrangement of the temperature control system and the configuration of the physical components showing the pulse width modulator 401, power source, power electronics 301, fusing system 302, and temperature controller 400 is given in FIG. 36. The temperature control system of FIG. 36 utilizes only one feedback quantity, the temperature of the fusing system 302. This results in the lowest cost implementation as an extremely low cost microcontroller (4001 of FIG. 34) may be used to implement the control system 400. Because most printer and copier control computers already measure the temperature of the fusing system, the best approach in a commercial implementation is to utilize the existing A/D 4000 already used by the microprocessor 4001 in the printer or copier engine. Typically, the temperature sensor consists of a negative temperature coefficient thermistor in a voltage divider network coupled to a first order low pass filter to remove high frequency noise. The bandwidth of the thermistor and low pass filter is relatively low, approximately 20 Hz, but much higher than the bandwidth of the fusing system.

Experimentation with a standard LMS adaptive system as described by Widrow showed that the system was stable and converged to a solution. However, it was found that the temperature of the fuser did not equal the desired temperature. This is due to the weightscaling of the measured temperature by the adaptive system as taught by Widrow. Therefore modification of the system is necessary to make the desired temperature $d_k$ dimensionally equivalent to the output of the adaptive linear combiner. This could be easily accomplished by multiplying the desired temperature by the present weight vector $w_k$ resulting in a new desired signal which constantly changes as the weight changes. This does not violate any of the design methodologies of adaptive systems. The new weight scaled desired temperature is just treated as the desired signal for the system and is dimensionally equivalent to the weight scaled measured temperature. Alternatively, the weight scaling of the corrected temperature measurement could be eliminated and the original desired temperature could be utilized. This approach does alter the form of the adaptive linear combiner and the performance surface however it is very easily implemented.

Figure 37:
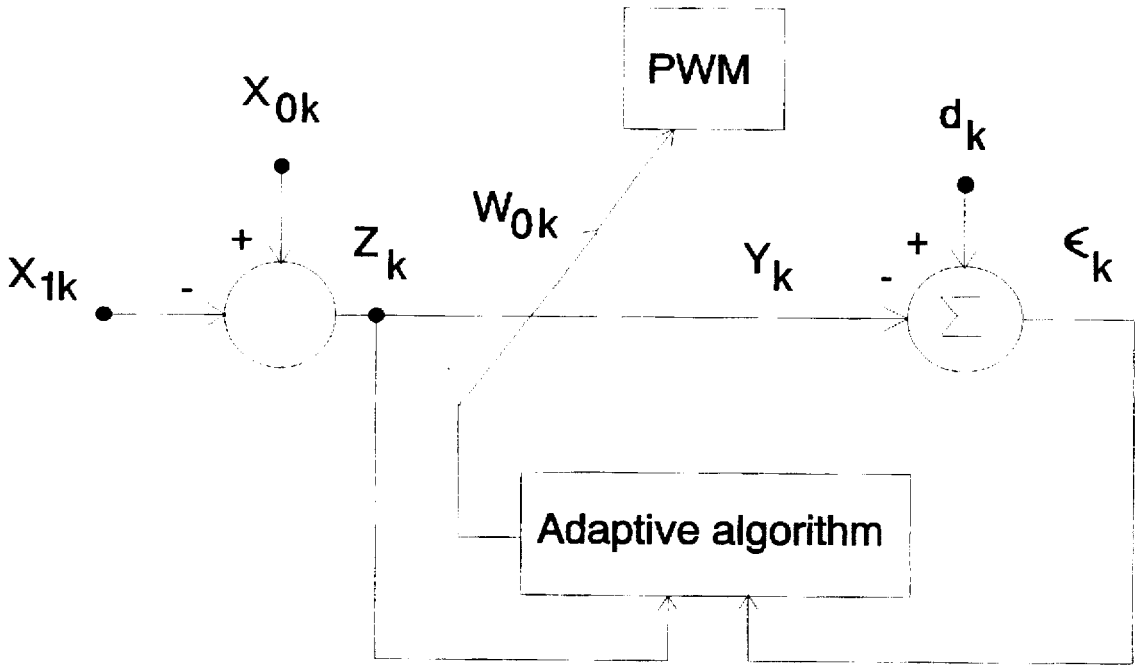
FIG. 37 shows a modified single input single weight adaptive temperature control system.

The multiplication of the corrected measured temperature by the adaptive weight vector was removed and the weight vector was instead supplied directly to the pulse width modulator. The output of the adaptive linear combiner, $y_k$, is now just the corrected positive temperature coefficient fuser temperature measurement, $x_k$. A diagram of this system is shown in FIG. 37.

The instantaneous error signal, $\epsilon_k$, for this modified adaptive system is now of the form $$\epsilon_k = d_k - x \qquad \text{eq. 71}$$

and the instantaneous square error, $\epsilon_k^2$, is now of the form $$(\epsilon_k)^2 = (d_k - x_k)^2 = (d_k)^2 - 2\cdot(d_k \cdot x_k) + (x_k) \qquad \text{eq. 72}$$

which is a parabola but not dependent on the system weight, $w_k$. This is different from, and apparently not in conformance with, the methods of Widrow.

The steady state temperature of the fuser is the product of the power delivered to the fuser and the thermal resistance, $R_\theta$, of the fuser to the ambient environment or $$T = P \cdot R_q = \frac{V^2 \cdot d}{R} \cdot R. \qquad \text{eq. 73}$$

For the time being the dynamics of the fusing system thermal resistance are being ignored such that the error surface of the modified LMS system may be examined.

Figure 38:
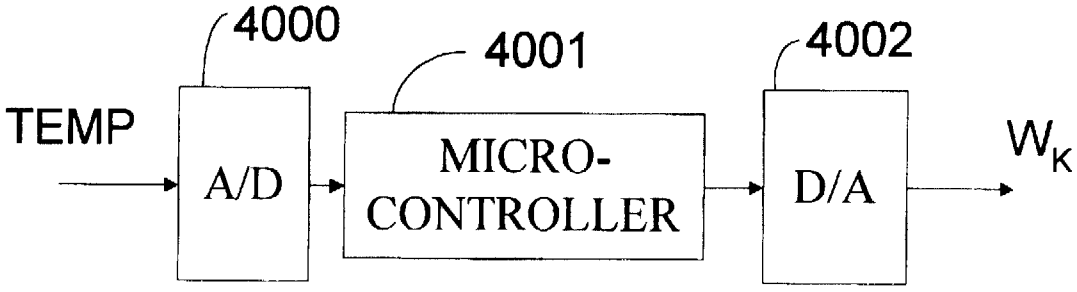
FIG. 38 is a block diagram of the controller of FIG. 36.

Referring to FIGS. 36 and 38, in the preferred embodiment the weight of the control system, $w_k$, is converted to an analog voltage by a micro-controller 4001 controlled D/A 4002 converter whose maximum output is 5 volts. The analog voltage from the D/A converter is in turn supplied to the linear voltage controlled pulse width modulator 401 which is designed for a duty cycle of 1 when its input voltage is equal to 5 volts. The power electronics linearly 301 control the power as a function of the duty cycle of the pulse width modulator 401. Thus, the duty cycle of the pulse width modulator can be expressed as a linear function of the control system weight as $$d = \frac{w_k}{5} \qquad \text{eq. 74}$$

Substituting equation 74 into equation 73 yields the fuser temperature as $$T = \frac{V^2 \cdot R_q \cdot w}{R \cdot 5} \qquad \text{eq. 75}$$

which is the positive temperature coefficient input to the adaptive linear combiner $$x_k = T = \frac{V^2 \cdot R_q \cdot w_k}{R \cdot 5} \qquad \text{eq. 76}$$

Therefore at the steady state the input signal can be considered a system constant, c, times the weight vector or $$x_k = c \cdot w \qquad \text{eq. 77}$$

and the error surface of equation 72 is quadratic with an imbedded weight multiplication when the system is near steady state. This fits the Widrow model with the system constant, c, corresponding to the response of the system. Due to the design of the system the measured temperature, $x_k$, has already been multiplied by the weight vector. Based on this line of reasoning it is appropriate to utilize the standard LMS gradient estimate for this modified system.

The system constant, c, changes for changes in AC source voltage, for changes in the heating element resistance, for changes in the thermal resistance of the fusing system as its rotational speed changes, as the ambient relative humidity changes, as the ambient environmental temperature changes and as media loads enter and leave the fuser platens.

The modified LMS weight update equation for this one weight adaptive system is $$W_{k+1} = W_k + 2\mu\epsilon_k X_k \qquad \text{eq. 78}$$

where $W_{k+1}$ is the next state value of the system weight, $W_k$ is the present value of the system weight, $\mu$ is the adaptation coefficient, $\epsilon_k$ is the error signal (which is the desired temperature minus the measured temperature), $x_k$ is the present measured temperature and the variable k is a time index.

The adaptation coefficient, $\mu$, is chosen such that linear one second ramps of the controller weight, $W_{k+1}$, are generated by the adaptive temperature control system. The phase lag of the fusing system causes the error signal, $\epsilon_k$, of the control system and the measured temperature, $x_k$, to essentially remain constant thereby automatically generating the linear ramping of the controller weight. Also recall that the adaptive controller weight, $W_{k+1}$, is directly controlling the duty cycle of the pulse width modulator and that the duty cycle of the pulse width modulator linearly controls the power supplied to the fusing system.

Fuser 302 also exhibits a large amount of pure time delay. With fuser 302 exhibiting pure time delay (i.e., phase lag) for a given time after a change in its input power, the temperature and hence the error signal of the control system remains constant. While the error is constant the next adaptive weight (Wk+1) of eq. 78, which is linearly controlling the average power delivered to the fuser, increase or decrease linearly. The phase lag causes the temperature controller to oscillate, simillar to a proportional controller with high gain.

Short term flicker measurements were performed on the printer under standard triac control and under control of the modified one weight LMS controller coupled with the new power control topology. These flicker measurements were performed with a 120 Vrms 60 Hz source with the printer printing continuously at its rated speed of 10 pages per minute. The flicker measurement for the standard triac based fusing power controller for a 5 minute short term flicker test was $P_{st5min}$=3.86. Ten minute flicker was found to be $P_{st10min}$=1.35. The first pass flicker measurement for the new power controller with the simple one weight modified LMS controller with 1 second linear duty cycle ramping yielded a $P_{st5min}$=0.875 and 10 minute flicker was $P_{st10min}$=0.77. This improvement would allow this printer, which currently fails the proposed European flicker limits, to pass.

One of the criteria that is used to compare competing laser printers and copiers against one another is the time required for the fusing mechanism to heat up from the "cold" state to the temperatures necessary for proper fusing. Due to the thermal mass of the fuser platens a large amount of energy is necessary to bring the fusing system up to operating temperature as fast as is reasonably possible. There are also limits to the available power levels that can be drawn from the household or office low voltage distribution system with the maximum available power level for worldwide use being approximately 1200 watts.

After fuser 302 has been brought up to operating temperature the amount of energy necessary for maintaining temperature and providing enough energy for proper fusing of toner to the print media is greatly diminished. Therefore, maximum power supplied to fuser 302 can be reduced. Of course the average power required changes greatly depending upon the thermal load of various media such differing paper weights and sizes as well as different media types such as overhead transparencies. The average power levels required for proper fusing also change as the amount of moisture in the paper varies with the changing relative humidity.

Gain scheduling (1103 of FIG. 34) slows down the ramp rate of the temperature controller once fuser 302 is near operating temperature. Also the maximum power supplied to fuser 302 is reduced by limiting the maximum duty cycle of pulse width modulator 401. Setting a maximum allowable duty cycle after fuser 302 has reached operating temperature is very easily accomplished in the algorithms which implement the temperature control program.

Fuser temperature control 1007 uses gain scheduling and maximum duty cycle limiting 1103 upon fuser 302 reaching its proper operating temperature 1102 in order to further reduce the flicker generated by the fusing system. Gain scheduling is easily accomplished by changing the adaptation coefficient, $\mu$, and changing the maximum allowable weight of the adaptive controller upon reaching operating temperature. After the initial warm-up period 1100, 1101, once the fusing system reaches its operating temperature 1102, the maximum duty cycle is reduced by 20% and the ramp rate is reduced from approximately 1.25 seconds to approximately 6 seconds 1103. The adaptive temperature control process 1104 then continues. Because the fuser is now near operating temperature, not as much power is necessary to compensate for thermal losses and paper thermal loading thus, the maximum filament power is lowered in order to reduce flicker.

Figure 39:
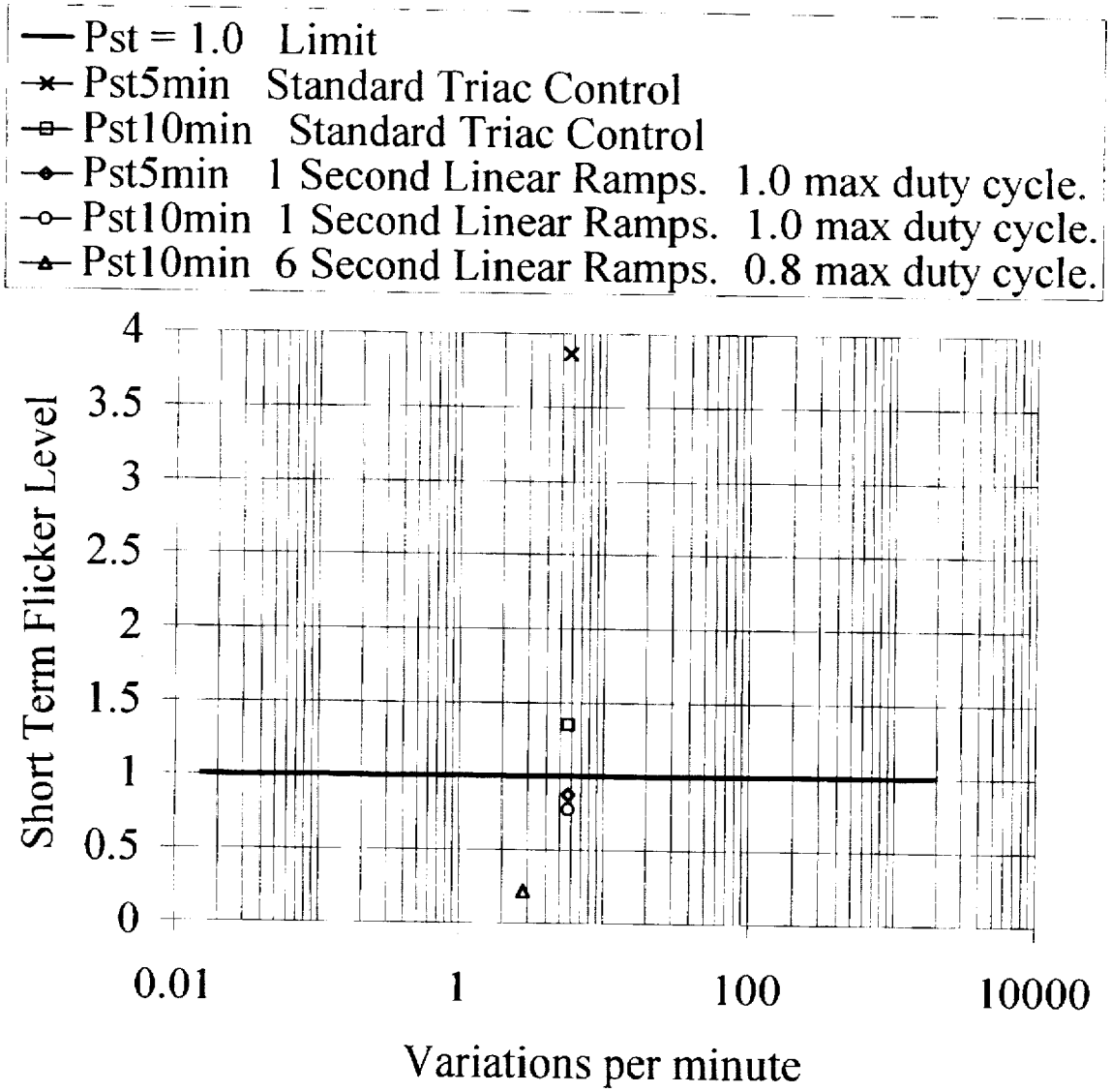
FIG. 39 shows flicker levels for triac and linear fuser power control with and without gain scheduling and maximum duty cycle limiting.

The temperature controller with modification for gain scheduling and duty cycle limiting altered the power fluctuations from 950 W for 4 seconds out of every 10 seconds to approximately 440 W for 26 seconds every 30 seconds. The flicker generated by the fusing system dropped to $P_{st10min}$=0.22. Recall in the previous implementation that did not utilize gain scheduling or duty cycle limiting that the short term flicker was measured at $P_{st10min}$=0.77 The results of the flicker reduction achieved from gain scheduling and maximum duty cycle limiting as well as the shift in the controller oscillation rate are shown in FIG. 39.

Further modifications could also be made in which when the printer is printing continuously that the temperature controller would also implement a minimum allowable duty cycle in conjunction to the maximum duty cycle discussed previously. All of these possible improvements to the simple temperature controller can be made through empirical testing to determine the best minimum duty cycle, maximum duty cycle, and adaptation coefficient for best fuser temperature control. These possible improvements allow the printer engine firmware designer to compensate for the phase lag of the system without implementing a more elaborate control system. These empirical methods are utilized extensively in printer design due to the wide variety of paper weights, widths and lengths that the customer uses for everyday printing needs.

It is interesting to again note that even with the modifications for gain scheduling and maximum duty cycle limiting the temperature controller is still behaving like an oscillating proportional temperature controller. Of course it does posses extremely low flicker levels which are very desirable. Also, the temperature performance was acceptable. These modified LMS type controllers had to use a relatively high adaptation coefficient to obtain satisfactory temperature control performance when paper was running through the printer fusing system. These high adaptation coefficient LMS based controllers and the inherent pure time delay of the fusing system cause them to perform very similarly to classic proportional controllers with the power levels fluctuating as temperature is maintained. Further reductions in the adaptation coefficient, $\mu$, should stabilize the temperature controller at the expense of inferior response to the unknown thermal loads of the printed media passing through the fuser.

Also a more rigorously designed LMS type adaptive control system with a large transverse filter and additional weights for sensing impending thermal loads could solve the power fluctuation problem but would require additional processor overhead or additional expense in the control computer. Neither of these options are presently viable as the typical printer engine utilizes one control computer for all paper path timing, electrophotographic process control, fuser temperature control, control of all peripheral circuits such as fan speeds and finally must communicate with the computer which is generating the rasterized print image data. All of this overhead already designed into the print engine control computer does not allow for much additional processor time for more elaborate fuser temperature control algorithms.

Figure 40:
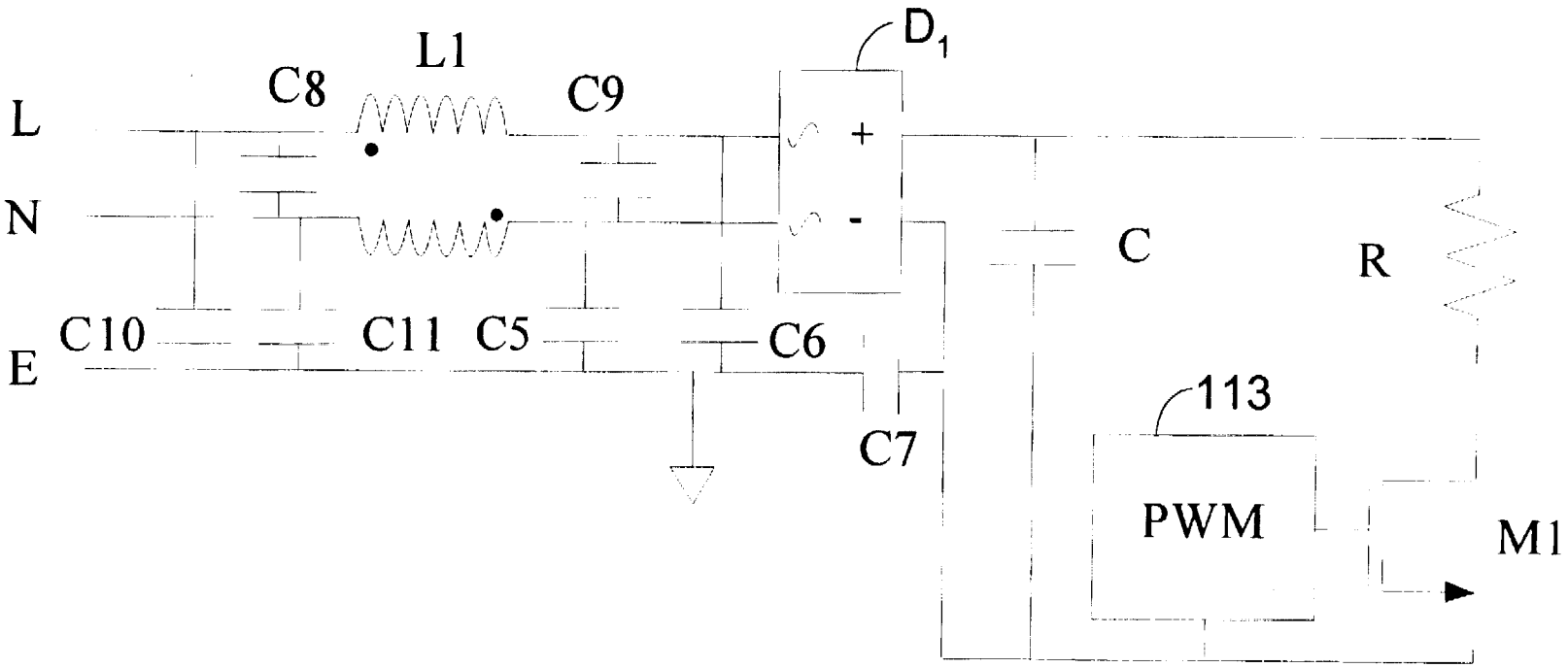
FIG. 40 shows an alternative embodiment in accordance with the present invention

One skilled in the art, after having read an understood the above disclosure, may make modifications as necessary for each unique application. For example, In order to meet international requirements governing conducted emissions the power input circuitry of both copiers and printers include common mode and differential mode filters. These filters filter out excessive high frequency current components that are generated by the power conversion circuitry within the printer or copier. Since this circuitry already exists within the printer or copier it may be used to advantage in the new fuser power control circuitry. The schematic in FIG. 40 details an alternative embodiment where the existing power filtering circuitry is utilized to filter out the majority of the current harmonics generated by pulse width modulating the fuser heating element.

The input common mode portion of the filter consists of capacitors C10, C11, C5, and C6; the differential filter uses C8, L1, and C9. C7 is utilized to prevent excessive levels of radiated emissions. Capacitor C further reduces generated conducted and radiated emissions by filtering noise generated by switching transitions of switch M1 and bridge rectifier D1.

This operation of this alternative embodiment is essentially identical to the previously described circuit except that the existing differential mode current filter and the common mode current filter filter the current harmonics generated by pulse width modulated switching of the fuser heating element R. The existing common mode and differential mode filters along with capacitor C now provide continuous conduction paths when heating element R is switched into and out of circuit by switch M1.

Although the preferred embodiment of the invention has been illustrated, and that form described, it is readily apparent to those skilled in the art that various modifications may be made therein without departing from the spirit of the invention or from the scope of the appended claims.

What is claimed is:

1. An apparatus for regulating an amount of power a heating element consumes, said apparatus comprising:

a power source;

a full-wave rectifier;

an inductor connected to said full-wave rectifier, said heating element connected to said inductor;

a capacitor connected to said inductor and said full-wave rectifier;

a switch connected to said heating element and said full-wave rectifier; and a controller means connected to said switch for turning said switch off and on thereby regulating said amount of power to said heating element.

2. The apparatus of claim 1 further comprising:

a means for sensing temperature of said heating element, said controller means turning said switch off and on in accordance with said means for sensing.

3. The apparatus of claim 1 further comprising:

a means for absorbing excess energy during said switching of said switch.

4. The apparatus of claim 1 wherein said power source further comprising a bridge rectifier.

5. The apparatus of claim 1 wherein said heating element is used in an electrophotographic device.

6. The apparatus of claim 1 wherein said heating element is a resistive device.

7. The apparatus of claim 1 wherein said heating element is an incandescent light.

8. The apparatus of claim 2 wherein:

said power source operating at a first frequency;

said inductor and said capacitor having a resonate frequency that is greater than said first frequency; and said controller means pulse width modulating said switch at a PWM frequency that is greater than said resonate frequency, said amount of power being directly proportional to pulse width.

9. The apparatus of claim 8 said controller means further comprising:

an error detection means for quantifying an error between a desired temperature of said heating element and said temperature of said heating element; and a processor, said processor executes a control program to control said pulse width modulation to minimize said error.

10. An apparatus for heating a heating element to a desired temperature, said apparatus comprising:

a power source;

a full-wave rectifier;

a switch connected to said heating element and said full-wave rectifier;

an inductor connected to said full-wave rectifier, said heating element connected to said inductor;

a capacitor connected to said inductor and said full-wave rectifier;

an error detection means for quantifying an error between said desired temperature of said heating element and said temperature of said heating element; and a processor, said processor executes a control program to generate a pulse width modulation signal to minimize said error, said pulse width modulation signal controls said switch.

11. The apparatus of claim 10 further comprising:

a means for absorbing excess energy during said switching of said switch.

12. The apparatus of claim 10 wherein:

said power source operating at a first frequency;

said inductor and said capacitor having a resonate frequency that is greater than said first frequency; and said pulse width modulating operating at a PWM frequency that is greater than said resonate frequency.

13. The apparatus of claim 12 wherein said processor increases a duty cycle of said pulse width modulation signal when said desired temperature is increased.

14. The apparatus of claim 10 wherein said heating element is used in an electrophotographic device.

15. The apparatus of claim 10 wherein said heating element is an incandescent light.

16. A circuit for controlling a temperature of a heat fixing device for use in an image forming apparatus, said circuit comprising:

an inductor connected to a full-wave rectifier, said heat fixing device connected to said inductor;

a capacitor connected to said inductor and said full-wave rectifier;

a switch connected to said heat fixing device and said full-wave rectifier; and a controller means connected to said switch for turning said switch off and on thereby controlling said temperature.

17. The circuit of claim 16 wherein said heat fixing device further comprising a means for sensing temperature of said heat fixing device, said controller means turning said switch off and on in accordance with said means for sensing.

18. The circuit of claim 16 wherein:

said power source operating at a first frequency;

said inductor and said capacitor having a resonate frequency that is greater than said first frequency; and said controller means pulse width modulating said switch at a PWM frequency that is greater than said resonate frequency.

19. The circuit of claim 18 said controller means further comprising:

an error detection means for quantifying an error between a desired temperature of said heat fixing device and said temperature of said heat fixing device; and a processor, said processor executes a control program to control said pulse width modulation to minimize said error.

20. The circuit of claim 16 further comprising a means for absorbing excess energy during said switching of said switch.

* * * * *